US011499366B1

(12) United States Patent
Palmer et al.

(10) Patent No.: US 11,499,366 B1
(45) Date of Patent: Nov. 15, 2022

(54) DOOR SYSTEM HAVING SOUND CONTROL AND RF SHIELDING AND METHODS OF MAKING SAME

(71) Applicant: Palmer's Security Solutions, LLC, Manassas, VA (US)

(72) Inventors: James Scott Palmer, Warrenton, VA (US); Matthew Thomas Palmer, Jeffersonton, VA (US)

(73) Assignee: PALMER'S SECURITY SOLUTIONS, LLC, Manassas, VA (US)

( * ) Notice: Subject to any disclaimer, the term of this patent is extended or adjusted under 35 U.S.C. 154(b) by 0 days.

(21) Appl. No.: 17/741,539

(22) Filed: May 11, 2022

Related U.S. Application Data

(60) Provisional application No. 63/188,488, filed on May 14, 2021.

(51) Int. Cl.
*E06B 5/18* (2006.01)
*E06B 5/10* (2006.01)
(Continued)

(52) U.S. Cl.
CPC ..... *E06B 5/10* (2013.01); *E06B 1/18* (2013.01); *E06B 1/34* (2013.01); *E06B 1/70* (2013.01);
(Continued)

(58) Field of Classification Search
CPC ..... E06B 5/18; E06B 5/20; E06B 5/10; E06B 7/16; E06B 2003/7051; E06B 2003/7049;
(Continued)

(56) References Cited

U.S. PATENT DOCUMENTS 2,110,893 A 3/1938 Sendzimir
3,716,462 A * 2/1973 Jensen ..... C23C 18/40 205/291
(Continued)

FOREIGN PATENT DOCUMENTS

DE 2142474 A1 3/1973
ES 1099930 U 2/2014
KR 101300660 B1 8/2013

OTHER PUBLICATIONS

Steel Door Institute, "Zinc-Coated (Galvanized/Galvannealed) Standard Steel Doors and Frames," Technical Data Series, SDI 112-97, https://www.commdoor.com/SDI_112.pdf (3 pages).

*Primary Examiner* — Kyle J. Walraed-Sullivan
(74) *Attorney, Agent, or Firm* — Kilyk & Bowersox, P.L.L.C.

(57) ABSTRACT

A door system and a method of making a door system including a metal door, a metal door frame for the metal door, and one or more door frame seals. The metal door and the metal door frame each include a steel outer surface with a first metal layer in contact with and that encapsulates or covers the steel outer surface, and a second metal layer in contact with and that encapsulates or covers the first metal layer. The first metal layer is different from the second metal layer. The first metal layer can be optional. The door frame seals are located on the metal door frame and provide conductivity between the metal door and the metal door frame. The door system preferably has an acceptable sound transmission class rating and RF shielding properties.

30 Claims, 10 Drawing Sheets

(51) Int. Cl.

| | |
|---|---|
| ***E06B 1/18*** | (2006.01) |
| ***E06B 1/34*** | (2006.01) |
| ***E06B 3/70*** | (2006.01) |
| ***E06B 7/23*** | (2006.01) |
| ***E06B 1/70*** | (2006.01) |

(52) U.S. Cl.
CPC ..... *E06B 3/7001* (2013.01); *E06B 7/2314* (2013.01); *E06B 3/7015* (2013.01); *E06B 2003/7049* (2013.01)

(58) Field of Classification Search
CPC ..... E06B 1/18; E06B 1/34; E06B 1/70; E06B 1/7015; E06B 3/76; E06B 3/7001; H05K 9/001; E04H 9/04; E04H 9/10
See application file for complete search history.

(56) References Cited

U.S. PATENT DOCUMENTS 4,069,618 A * 1/1978 Geiss ..... H05K 9/0016 174/351
4,098,633 A * 7/1978 Kersten ..... H05K 9/0015 174/363
4,285,995 A 8/1981 Gomersall
4,296,181 A * 10/1981 Nehra ..... C23C 18/1653 427/427
4,370,831 A * 2/1983 Hamilton ..... H05K 9/0015 174/382
4,371,175 A * 2/1983 Van Dyk, Jr. ..... E06B 7/2318 277/646
4,399,317 A * 8/1983 Van Dyk, Jr. ..... H05K 9/0015 174/370
4,571,449 A * 2/1986 Lindenberger ..... H05K 9/0016 174/374
4,590,710 A * 5/1986 Newland ..... E05C 19/161 49/478.1
4,642,416 A * 2/1987 Rogner ..... H05K 9/0015 174/357
4,677,251 A * 6/1987 Merewether ..... H05K 9/0016 174/368
4,691,483 A * 9/1987 Anderson ..... E04H 9/10 49/400
4,746,765 A * 5/1988 Mallott ..... H05K 9/0015 49/477.1
4,786,758 A 11/1988 Zielinski
4,817,337 A * 4/1989 Lahita ..... E06B 7/2314 174/384
4,910,920 A * 3/1990 Nichols ..... H05K 9/0016 49/495.1
5,017,736 A * 5/1991 Yarger ..... H05K 9/0001 174/364
5,045,636 A * 9/1991 Johnasen ..... E06B 5/18 174/375
5,324,545 A 6/1994 Flamme
5,335,464 A * 8/1994 Vanesky ..... H05K 9/0001 174/374
5,581,048 A * 12/1996 Shores ..... F16J 15/064 277/921
6,914,184 B1 * 7/2005 Lahita ..... H05K 9/0015 174/374
6,965,071 B2 11/2005 Watchko et al.
6,992,246 B2 * 1/2006 Christou ..... H05K 9/0001 174/374
7,117,640 B2 10/2006 Hurzeler
7,246,681 B2 * 7/2007 Christen ..... H05K 9/0001 181/290
7,491,898 B2 * 2/2009 Villanella ..... H05K 9/0016 174/382
8,176,682 B2 * 5/2012 Gaviglia ..... E06B 5/20 49/501
8,181,417 B2 * 5/2012 Surace ..... E04F 15/20 52/642
8,925,251 B1 * 1/2015 Rust ..... E06B 7/18 49/495.1
9,820,415 B1 * 11/2017 Rust ..... H05K 9/0001
9,828,798 B1 * 11/2017 Lahita ..... E06B 5/18
2003/0167697 A1 * 9/2003 Hurzeler ..... H05K 9/0001 49/501
2006/0080897 A1 * 4/2006 O'Neal ..... E04H 9/06 52/1
2007/0007037 A1 * 1/2007 Diaferia ..... H05K 9/0015 174/382
2008/0296100 A1 12/2008 Lee et al.
2009/0038261 A1 * 2/2009 Lee ..... E06B 3/7017 156/212
2010/0096180 A1 * 4/2010 Carducci ..... H05K 9/0001 174/364
2011/0171396 A1 7/2011 Pershin et al.
2012/0085223 A1 4/2012 Kennedy et al.
2013/0133261 A1 * 5/2013 Choi ..... B32B 5/26 428/57
2013/0244052 A1 9/2013 Mullock
2014/0069038 A1 * 3/2014 Back ..... E06B 1/32 52/745.15
2015/0152679 A1 * 6/2015 Kolobayev ..... E06B 5/20 49/305
2019/0032392 A1 * 1/2019 Cordes ..... E06B 7/2318
2019/0063098 A1 * 2/2019 Cordes ..... E04H 9/10
2020/0113088 A1 * 4/2020 Hansen ..... B32B 5/26
2021/0131170 A1 * 5/2021 Glover ..... E06B 3/7015
2021/0163347 A1 * 6/2021 You ..... C03C 17/366
2022/0078951 A1 * 3/2022 Rodgers ..... E06B 7/205

* cited by examiner

DOOR SYSTEM HAVING SOUND CONTROL AND RF SHIELDING AND METHODS OF MAKING SAME

BACKGROUND OF THE INVENTION

This application claims the benefit under 35 U.S.C. § 119(e) of prior U.S. Provisional Patent Application No. 63/188,488, filed May 14, 2021, which is incorporated in its entirety by reference herein.

The present invention relates to door systems (e.g., door with door frame) and more particularly relates to door systems having sound control and radio frequency (RF) shielding properties. The present invention further relates to rooms that are RF shielded that include the door system, and the present invention relates to methods of making the door system.

In the area of sound control and RF shielding, while there are doors available, some of these doors have a sound transmission class rating and/or RF shielding rating that could be better and/or some of these doors utilize materials or components which are not cost effective.

Thus, there is a need to provide a door system having improved sound control and/or RF shielding properties and/or other advantages as described herein.

SUMMARY OF THE INVENTION

A feature of the present invention is to provide a door system that provides an acceptable sound transmission class rating and RF shielding properties.

Another feature of the present invention is to provide methods to modify a commercially available door so that the door has an acceptable sound transmission class rating and has RF shielding properties.

A further feature of the present invention is to provide a RF shielded room that includes a door system.

Additional features and advantages of the present invention will be set forth in part in the description that follows, and in part will be apparent from the description, or may be learned by practice of the present invention. The objectives and other advantages of the present invention will be realized and attained by means of the elements and combinations particularly pointed out in the description and appended claims.

To achieve these and other advantages, and in accordance with the purposes of the present invention, as embodied and broadly described herein, the present invention relates to a door system that includes a) a metal door, b) a metal door frame for the metal door, and c) one or more door frame seals. The metal door and the metal door frame each include a steel outer surface (e.g., steel door panels) that has a first metal layer in contact with and that encapsulates or covers or coats the steel outer surface, and a second metal layer in contact with and that encapsulates or covers or coats the first metal layer, wherein the first metal layer is different from the second metal layer. The one or more door frame seals are located on the metal door frame and provide conductivity and/or sound proofing between the metal door and the metal door frame. Also, the door system preferably has a sound transmission class rating of at least STC 30 or at least STC 40 or at least STC 50 and/or an RF shielding (RF attenuation) as described herein.

The present invention further relates to a RF shielded room that includes RF shielded walls, a RF shielded ceiling, and a RF shielded floor, and the door system of the present invention.

The present invention further relates to a method of making the door system of the present invention. The method includes the steps of applying a first metal layer onto a steel outer surface of a metal door, such as by metal inert gas welding in the form of spray, and then applying a second metal layer onto the first metal layer. The method includes applying the first and second metal layers in a like manner to the metal door frame as well.

It is to be understood that both the foregoing general description and the following detailed description are exemplary and explanatory only and intended to provide a further explanation of the present invention, as claimed.

The accompanying drawings, which are incorporated in and constitute a part of this application, illustrate some of the features of the present invention and together with the description, serve to explain the principles of the present invention.

DETAILED DESCRIPTION OF THE PRESENT INVENTION

Figure 1:
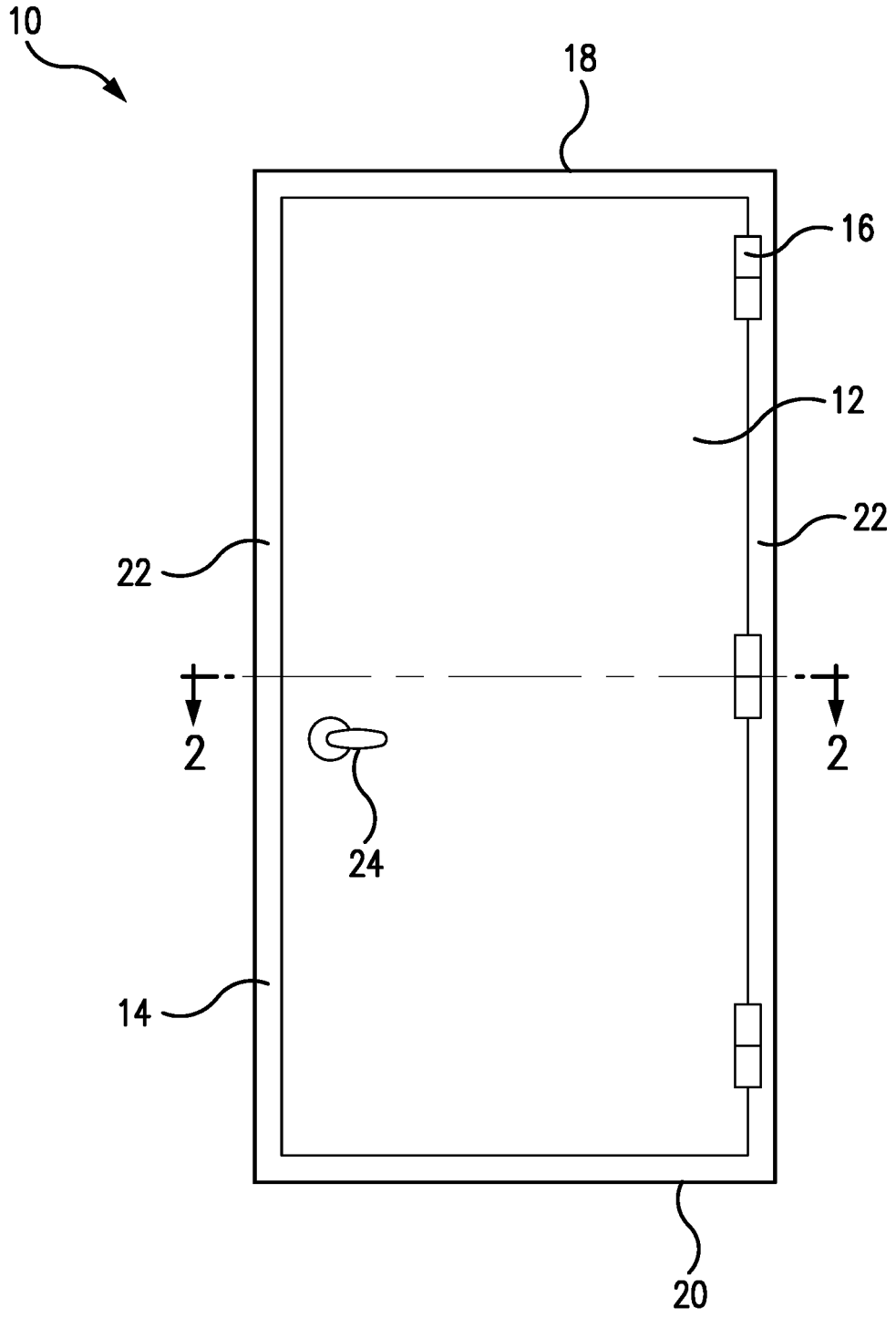
FIG. 1 is front view of a door system of an embodiment of the present invention, having sound control and RF shielding.

The present invention relates, in part, to a door system having sound control and RF shielding properties, and methods of making the same.

The STC or sound transmission class is a single number method of rating how well doors and wall partitions reduce sound transmission. A higher number indicates more effective sound insulation than a lower number. The STC is a standardized rating provided by ASTM E413 based on laboratory measurements performed in accordance with ASTM E90. ASTM E413 can also be used to determine similar ratings from field measurements performed in accordance with ASTM E336. For purposes of the present invention, the STC numbers provided herein are measured in accordance with these standards. Sound Isolation and Sound Insulation are used interchangeably. Following these standards, with the present invention's door system, in laboratory measurements, the door and/or door system can have a STC rating of at least 30, at least 40, at least 45, at least 50, at least 52, at least 55, or at least 60 (such as from 30 to 60 STC rating, or 40 to 60 STC rating, or 45 to 60 STC rating, or 45 to 55 STC rating). In field testing, the STC rating may be slightly lower, such as from about 1% to 5% lower than the laboratory test numbers provided here. The STC rating can be considered as a sound attenuation rating with units in dB.

Electromagnetic shielding is the practice of reducing the electromagnetic field in a space by blocking the field with barriers made of conductive or magnetic materials. Shielding is typically applied to enclosures to isolate electrical devices from their surroundings. Electromagnetic shielding that blocks radio frequency (RF) electromagnetic radiation is also known as RF shielding. The shielding preferably reduces the coupling of radio waves, electromagnetic fields, and electrostatic fields. Electromagnetic shielding is the process of lowering the electromagnetic field in an area by barricading it with conductive or magnetic material.

With the present invention, the door and/or door system of the present invention can have RF shielding or RF attenuation or blocking properties or abilities. The door and/or door system can have a RF shielding rating or a RF attenuation of at least 30 dB, at least 40 dB, at least 60 dB, at least 80 dB, or at least 100 dB as determined by laboratory measurements or field measurements performed in accordance with U.S. Government specifications for testing the attenuation of a material according to IEEE 299 v6. When laboratory measurements are conducted, a room (enclosure) having a standard RF shielded wall setting (essentially a hermetically sealed room but for the door) is utilized so that the enclosures around the door/door system do not affect or contribute to the RF shielding rating. When field measurements or field tests are conducted and RF shielding ratings are obtained, a more realistic setting is provided and thus the RF shielding effectiveness will generally produce RF shielding numbers that are lower than laboratory measurements. In field testing, the RF attenuation rating may be slightly lower, such as from about 1% to 10% lower or from about 1% to 5% lower than the laboratory test numbers provided here.

With the present invention, in a laboratory setting (laboratory measurement), a RF shielding effectiveness (or an RF attenuation) of at least 40 dB, or at least 42 dB, or at least 50 dB, or at least 60 dB, or at least 80 dB, or at least 100 dB (such as from 40 dB to 100 dB, or 50 dB to 80 dB, or 55 dB to 75 dB) is achievable over a frequency range of from about 10 MHz to about 2 GHz or over a frequency range of from 10 kHz to 10 GHz, with the door/door system of the present invention. In field testing, a RF shielding effectiveness of at least 40 dB, or at least 42 dB, or at least 50 dB, or at least 60 dB, or at least 80 dB (such as from 40 dB to 80 dB, or 45 dB to 75 dB, or 50 dB to 70 dB, or 60 dB to 65 dB) is achievable over a frequency range of from about 10 MHz to about 2 GHz or over a frequency range of from 10 kHz to 10 GHz with the door system of the present invention. This RF shielding effect can be with respect to the door system itself and/or with a RF-shielded room that includes the door system of the present invention. These RF shielding numbers can be an average number over the entire frequency range of 10 MHz to about 2 GHz or the entire frequency range of 10 kHz to 10 GHz and/or can be an average number over a portion of this frequency range, such as from 10 kHz to 1 GHz, or from 10 kHz to 500 MHz, or from 10 MHz to 500 MHz, or from 10 MHz to 250 MHz, or some other portion of this entire frequency range.

The door and/or door system of the present invention can be considered a RFI shielded door/door system.

The door and/or door system of the present invention can be considered an EMI resistant door/door system.

The door system at least includes a metal door attached to a door frame by at least one hinge (e.g., one, two, or three, or four hinges). The metal door can be a single door or a double door. The preferred properties with respect to RF shielding alone or in combination with the sound transmission rating described herein can be achieved for the single metal door by the present invention or for a double metal door. The door system further includes door frame seals to provide conductivity and/or sound seals between the metal door and the door frame.

The door frame and the metal door can be any suitable size, weight, and shape that allows a person to open the metal door and walk through the doorway defined by the door frame. In one embodiment, the door frame and the metal door can provide an Americans with Disabilities Act (ADA) clear opening in which the distance from the inside of the door panel to the opposite jam is at least 32 inches (e.g., 32 inches to 48 inches or more) or 32 and /1;32 inches with the door open to 90° . As an example, the doorway defined by the door frame can have a width of 36 inches and a height of 96 inches. The metal door can have a width of 35 and ¾ inches, a height of 95 and /3;16 inches, and a thickness of 1 and ⅞ inches. As an example, the door can weigh about 10 pounds per square foot (this amount can be amounts within ±15% or ±10% or more).

The door frame of the present invention can be a split frame having sound control and RF shielding properties. The split frame can include two jamb members that interlock together from opposite openings of the doorway. For example, a first jamb member can include a jamb, an interlocking feature, and the metal door hingedly connected to the side jamb. A second jamb member can include a jamb and an interlocking feature. The first jamb member is placed within the opening on a first side of the doorway and is secured within the doorway. The second jamb member is placed within the opening on an opposite side of the doorway and interlocks with the first jamb member via the interlocking features. The split frame of the present invention allows walls of an enclosure having RF shielding to already be finished and painted when installing the door frame and metal door. Alternatively, the door frame can be welded to the structure during the construction of the walls of the enclosure.

Each of the metal door and the door frame can include a steel outer surface. The steel outer surface of the metal door and door frame can be stainless steel, carbon steel, galvanized steel, or other types of steel. Carbon steel can have a carbon content of from about 0.05 wt% up to 3.8 wt%, based on the total weight of the steel (such as from 0.05 wt% to 0.25 wt% carbon, or from 0.3 wt% to 0.5 wt% carbon, from 0.6 wt% to 1 wt% carbon, or from 1.25 wt% to 2 wt% carbon). The present invention is particularly useful with carbon steel doors.

This metal door can have a smooth surface to receive the metal layer(s) or can be a rough or textured surface (e.g., pitted surface such as from sand blasting or other roughening methods, such as acid treating and the like). A roughed or textured surface can be useful to better receive the metal layer(s) described herein.

A first metal layer is present (e.g., attached, fused, coated, located) on the steel outer surface of each of the metal door and the door frame. A second metal layer is present (e.g., attached, fused, coated, located) on the first metal layer. Each of the first and second metal layer can be considered continuous layers and/or uniform layers. The first metal layer is a different metal than the second metal layer. The first metal layer can comprise one single layer or can comprise two or more layers. The second metal layer can comprise one single layer or can comprise two or more layers. The metal layer(s) can be formed so as to create a smooth surface or a roughed or textured surface.

The first metal layer that is present on the steel outer surface of the metal door and the steel outer surface of the door frame is a metal (or metal alloy) having electrical conductivity. The first metal layer preferably is present on the steel outer surfaces of the metal door and metal door frame such that metal of the first layer fuses at least partially into the steel outer surface of the door and door frame. For instance, at least a portion of the first metal layer forms an intermetallic zone or interface with the steel outer surface of the metal door and metal door frame. At least 1% of the total thickness of the first metal layer can fuse or form an intermetallic zone with the steel outer surface of the metal door and metal door frame. For instance, from about 5% to 90% or more of the thickness of the first metal layer can fuse into the steel outer surface of the metal door and door frame, such as from 5% to 80%, from 5% to 70%, from 5% to 60%, from 5% to 50%, from 5% to 40%, from 5% to 30%, from 5% to 25%, from 5% to 15%, or other ranges within any of these ranges.

The first metal layer can be considered in certain embodiments as an intermediate layer or can be considered a primer layer (e.g., a layer that is compatible with the steel outer surface and compatible with the second metal layer or at least more compatible with the steel outer surface and/or second metal layer).

The metal of the first metal layer can be, but is not limited to, zinc or an alloy of zinc, nickel or an alloy thereof, or other metal. Preferably, a metal present in the first metal layer is interpolable with the steel surface or is soluble (or partially soluble) with a metal or component thereof of the steel.

The thickness of the first metal layer can be any thickness, such as at least 5 microns or more, such as at least 10 microns, at least 20 microns, or from about 5 microns to about 150 microns, from about 5 microns to about 125 microns, from about 5 microns to about 100 microns, from about 5 microns to about 75 microns, from about 5 microns to about 50 microns, from about 10 microns to 175 microns, from about 15 microns to about 175 microns, from about 20 microns to about 175 microns, from about 25 microns to about 175 microns, from 40 microns to about 175 microns, and the like. The thickness can be below or above any one of these ranges provided. These can be considered average thicknesses of the layer.

The first metal layer can be formed on the steel outer surfaces by one or more of the following techniques: fusion welding (fusion welding includes traditional welding methods such as gas tungsten arc and gas metal arc, where gas tungsten arc welding is also known as tungsten inert gas (TIG) welding, and gas metal arc welding is also known as metal inert gas (MIG) welding), low-dilution welding (e.g., laser welding, pulsed arc welding or electron beam), and/or non-fusion joining (e.g., friction welding, diffusion bonding, soldering and explosion welding).

The second metal layer that is present on the first metal layer is a metal having conductivity. The conductivity (e.g., electrical conductivity) of the second metal can be greater than the first metal of the first metal layer. For instance, the conductivity of the second metal can be at least 10% more conductive, or at least 25%, or at least 50%, or at least 75%, or at least 100% or at least 150% or at least 200% more conductive than the first metal.

The second metal layer is preferably present on the first metal layer such that metal of the second metal layer fuses at least partially into the metal of the first metal layer. For instance, at least a portion of the first metal layer forms an intermetallic zone or interface with the second metal layer. At least 1% of the total thickness of the second metal layer can fuse or form an intermetallic zone with the first metal layer that is on the metal door and metal door frame. For instance, from about 5% to 90% or more of the thickness of the second metal layer can fuse into the first metal layer on the metal door and door frame, such as from 5% to 80%, from 5% to 70%, from 5% to 60%, from 5% to 50%, from 5% to 40%, from 5% to 30%, from 5% to 25%, from 5% to 15%, or other ranges within any of these ranges.

The metal of the second metal layer can be, but is not limited to, copper or an alloy of copper, or aluminum or an alloy thereof, gold or an alloy thereof, silver or an alloy thereof, stainless steel or an alloy thereof, bronze or an alloy thereof and the like. Preferably, a metal present in the second metal layer is interpolable with the first metal layer or is soluble (e.g., at least partially soluble) with a metal or component thereof of the first metal layer. The metal can be a metal having an electric conductivity ($10^6$ Siemens/m) of at least 15 $\times 10^6$ Siemens/m, such as at least $20\times10^6$ Siemens/m or at least $30\times10^6$ Siemens/m or at least $40\times10^6$ Siemens/m or at least $50\times10^6$ Siemens/m or at least $55\times10^6$ Siemens/m or from $15\times10^6$ Siemens/m to $55\times10^6$ Siemens/m or from $15\times10^6$ Siemens/m to $60\times10^6$ Siemens/m.

The thickness of the second metal layer can be any thickness, such as at least 5 microns or more, such as at least 10 microns, at least 20 microns, or from about 5 microns to about 150 microns, from about 5 microns to about 125 microns, from about 5 microns to about 100 microns, from about 5 microns to about 75 microns, from about 5 microns to about 50 microns, from about 10 microns to about 175 microns, from about 15 microns to about 175 microns, from about 20 microns to about 175 microns, from about 25 microns to about 175 microns, from 40 microns to about 175 microns, and the like. The thickness can be below or above any one of these ranges provided. These can be considered average thicknesses of the layer.

The second metal layer can be formed on the first metal layer by one or more of the following techniques: fusion welding (fusion welding includes traditional welding methods such as gas tungsten arc and gas metal arc, where gas tungsten arc welding is also known as tungsten inert gas (TIG) welding, and gas metal arc welding is also known as metal inert gas (MIG) welding), low-dilution welding (e.g., laser welding, pulsed arc welding or electron beam), and/or non-fusion joining (e.g., friction welding, diffusion bonding, soldering and explosion welding).

As an option, the intermetallic zone from the first metal layer-steel outer surface does not merge with the intermetallic zone from the second metal layer-first metal layer.

As an option, the intermetallic zone from the first metal layer-steel outer surface can at least partially merge with the intermetallic zone from the second metal layer-first metal layer.

The layers formed on the metal door and metal door frame can be generally such that the layer(s) is uniformly or substantially uniformly applied. The layers formed can be such that they fully encapsulate or coat or cover the surface that the layer is being applied to. Thus, the first metal layer encapsulates or coats or covers the steel outer surface and the second metal layer encapsulates or coats or covers the first metal layer. For purposes of the present invention, fully encapsulate (or fully coat or fully cover) means at least 90% of the entire exposed outer surface layer (in cross-sectional area) is encapsulated or coated or covered, such as at least 95%, at least 99%, or 100% of the exposed outer surface layer.

As an option, and as a further embodiment of the present invention, the first metal layer is optional, meaning the second metal layer is applied directly on the steel outer surface of the metal door and metal door frame and there is no first metal layer.

As an option, the outer most surface, meaning the second metal layer can be coated or covered with one or more conductive coatings, such as one or more conductive paint layers, one or more coats of rust inhibitive prime paint or material, one or more conductive veneer layers, one or more panels, or finishes.

For purposes of the present invention, unless stated otherwise, the reference to "conductive" or "conducting" used throughout is a reference to electrically conductive or electrically conducting or forming an electrical contact.

As an option, the steel outer surface of the door and/or door frame can first be prepped for application of the first and/or second metal layer. For instance, the steel outer surface can be cleaned such as by sand blasting or with other cleaning techniques (e.g., acid cleaning or washing, sanding, and the like).

The metal door that receives the first metal layer and/or second metal layer can be a commercially available door such as a door from the Overly Door Company (e.g., SC series of doors, such as STC 50 or STC 53 models), Shielding Resources Group, Inc. (e.g., Ultra-RF/A door), MegaMet doors, or Kreiger doors. For example, the metal door that can be used to add the metal layer(s) of the present invention can be the door assembly as described in U.S. Pat. No. 5,417,029, incorporated in its entirety by reference herein.

The metal door can have outer panels that define an internal space. An acoustically insulated core can be disposed within the internal space. The outer panels can include a front panel that has an interior surface and an exterior surface and a back panel that has an interior surface and an exterior surface. The back panel is spaced apart from the front panel and is substantially parallel thereto with the interior surface of front panel facing the interior surface of the back panel. The outer panels can further include side panels, a top panel, and a bottom panel that can be fastened to the front and back panel by any fastening material, such as but not limited to, adhesive, bonding, solder, rivets, welds, and the like to form the metal door. Interior surfaces of the front, back, top, bottom and side panels define the internal space therebetween.

As an option, the front panel and the back panel are integrally connected to the sides. For example, the front panel can include a face portion and side portions. The side portions can be integrally connected to the face portion and are out of the plane of the face portion such that an interior surface of the face portion cooperates with the interior surface of each side portion to define an angle therebetween, such as a right angle or a substantially right angle.

The back panel can also include a face portion and side portions. The side portions can be integrally connected to the face portion and are out of the plane of the face portion such that the interior surface of the face portion of the back panel cooperates with the interior surface of each back panel side portions to define an angle therebetween, such as a right angle or a substantially right angle.

As an option, the front panel can be secured to the back panel by internal connecting members. The internal connecting members can be located or aligned substantially parallel to the sides or side panels. The internal connecting members can include base segments that are in contact with the interior surfaces of the front panel and the back panel. The base segments can be attached to the interior surfaces of the front panel and the back panel by any fastening material, such as but not limited to, adhesive, bonding, solder, rivets, welds, and the like.

As an option, internal reinforcements can be present and can be attached by any fastening material, such as but not limited to, adhesive, bonding, solder, rivets, screws, welds, and the like to the metal door within the internal space. The internal reinforcements can provide additional rigidity and strength to the metal door.

The internal reinforcements can be an array of support members disposed vertically, horizontally, diagonally, or the like relative to the front and back panels of the metal door. The support members can be elongated beams that can extend along a partial or an entire width, length, or both of the internal space of the metal door. The support members can have a cross sectional shape that includes an I-shape, E-shape, Z-shape, C-shape, H-shape, M-shape, or the like. The array of support members can be secured to the interior surface of the front and back panel by adhesive, bonding, solder, rivets, screws, welds, or a combination thereof.

As an option, at least one crosspiece that runs perpendicular to the support members can be secured to the interior surface of the front and back panel by adhesive, bonding, solder, rivets, screws, welds, or a combination thereof to provide added rigidity and strength to the panels. Crosspieces can be placed at a top, a bottom, a first side, a second side, or a combination thereof of the metal door. For example, crosspieces can be placed at the top and the bottom of the metal door if the support members are vertically disposed. Crosspieces can be placed at the first and second side of the metal door if the support members are horizontally disposed.

As an option, crosspieces can be notched at regular intervals with each notch dimensioned to receive an end of one of the support members so that the crosspiece provides lateral separation between the support members.

As an option, each of the support members can include two separate pieces, such as a first section attached to the front panel and a second section attached to the back panel. Attenuator strips can be disposed in between the first section and the second section. For example, the first and second sections can each include lip edges that are located opposingly and spaced apart to form a corresponding array of gaps therebetween. An array of attenuator strips can be respectively located in the gaps and bond the lip edges of the first and second sections together.

The attenuator strips can be made of a neoprene rubber or other porous and flexible low-density materials with similar physical properties. The attenuator strips can be continuous throughout the gaps or can include a series of pads that are spaced along the gaps. The attenuator strips can further limit the propagation of vibration between the support members.

As mentioned above, an acoustically insulated core can be disposed within the internal space. For example, an insulating material can be disposed within the internal space in between the panels. The insulating material can further be disposed within the internal spaces in between the support members, crosspieces, or a combination thereof.

The insulating material can be acoustic foam, acoustic panels, acoustic fabric, acoustic coatings, acoustic drywall, acoustic glass, or a combination therefore. For example, the insulating material can be mineral wool, fiberglass, wood wool, gypsum, plywood, sealant, mass loaded vinyl, paint, cork, foam, spray foam, felt, or a combination thereof. The insulating material, such as mineral wool, can have a density from 4 $lb/ft^3$ to 15 $lb/ft^3$, from 6 $lb/ft^3$ to 12 $lb/ft^3$, or from 8 $lb/ft^3$ to 10 $lb/ft^3$. The insulating material absorbs sounds waves and thereby prevents sound waves from passing through the door.

As an option, cover strips can be placed in contact with welds to partially dampen mechanical vibrations that are transmitted therethrough. Cover strips can be made of a flexible and porous material such as neoprene rubber or a plastic material of similar physical properties. The cover strips can have a durometer of from 20 to 100, from 30 to 90, from 40 to 80, from 50 to 70, from 55 to 60, from 60 to 65 or other ranges within any of these ranges. Cover strips can further attenuate sound vibrations that might otherwise be transmitted between the panels of the metal door.

In general, to further ensure or increase the RF-shielding properties, conductive seals, conductive gaskets, conductive adhesive, conductive material (foil panels), conductive filler, conductive coatings (e.g., paint) and/or conductive caulk can used at any seam, any joint, any edge and/or any gap, or underneath any part, adjacent to any part and/or at part of the door system or RF-shielded room of the present invention.

In general, to further ensure or increase the sound proof properties, a sound seal or sound proof seal can be used such as a magnetic seal.

As an option, the seals can be multiple seals, meaning two or more seals can be adjacent to each other, for instance on a door frame. An RF seal can be adjacent and run parallel to a sound seal around a portion or the entirety of the door frame. As a further option, the RF seal can be the outer most seal or the sound seal can be the outer most seal.

The door frame can include a door head, a door sill, and door jambs. The door sill can include a steel or stainless-steel threshold that is electro-mechanically connected to the door frame. The metal threshold can have conductive seals, conductive caulk, and/or a metal foil underneath. The metal door can be hingedly connected to one of the door jambs by at least one hinge, such as a plurality of hinges. The hinge or hinges can be a ball bearing hinge, a butt hinge, a piano hinge, a flush hinge, a spring hinge, a pivot hinge, a concealed hinge, or the like. Sound isolators, such as solid neoprene, can be attached to the door above and below the hinge cutouts.

The metal door can further include locking hardware. The locking hardware can be affixed or attached to the metal door and can include either a conductive sealant or conductive gasket or both.

For instance, the locking hardware can engage with at least one strike plate of the door jamb in a locked position. The locking hardware can include door handles and dead bolts that are attached to the metal door. The locking hardware and the at least one strike plate can be mounted using conductive sealants, conductive gaskets, or both. Sound isolators, such as solid neoprene, can be attached to the door above and below lock cutouts.

The door system can further include door frame seals located on the metal door, the metal door frame, or a combination thereof to provide conductivity and/or enhance sound proofing between the metal door and the metal door frame when the metal door is closed.

As an option, door frame seals include radio frequency (RF) contacts and/or sound seal contacts that are attached to the door jambs, the door sill, and the door head of the door frame, or along a perimeter of the metal door, or a combination thereof.

RF contacts of the door jambs, the door sill, and the door head can make electrical contact with the metal door when the metal door is closed. RF contacts on the perimeter of the metal door can make electrical contact with the door jambs, the door sill, and the door head when the metal door is closed. Or, a combination of RF contacts of the doorjamb and the metal door can make contact when the metal door is closed.

As an example, RF contacts can be constructed as a row of low-pressure tin plated beryllium copper electrical contact strips or another material having similar conductive properties, such as but not limited to, silver, copper, gold, aluminum, zinc, lithium, nickel, stainless steel, an alloy thereof, such as brass, or a combination thereof. RF contacts of the door jambs, the door sill, and the door head can make electrical contact with the metal door when the metal door is closed. RF contacts on the perimeter of the metal door can make electrical contact with the door jambs, the door sill, and the door head when the metal door is closed. Or, a combination of RF contacts of the doorjamb and the metal door can make contact when the metal door is closed.

As an option, in one or more embodiments, the door frame or a portion thereof can include one or more door frame seals. The door frame seals can be considered RF contacts and/or sound contact seals. At least one of the door frame seals is preferably designed to be electrically conductive (i.e., electrical contact) so that when the door itself contacts the door frame seal, the door, door frame seal, and door frame are in conductive communication with each other. The door frame seal can include or comprise neoprene/silicone core with a conductive metal woven wire around the core or can be other designs and/or materials.

As an option, the door jambs, the door head, and the door sill can include a mounting flange that is in electrical contact with the door frame. Conductive adhesive or other conductive attachment material can be used along with the mounting flange. The mounting flanges can be constructed of suitable materials, such as steel or another electrically conductive material, such as silver, copper, gold, aluminum, zinc, lithium, nickel, stainless steel, an alloy thereof, such as brass, or a combination thereof. As an option, the RF and/or sound proofing contacts (e.g., RF seals and/or sound seals or gaskets) are fastened or attached to the mounting flanges.

As an option, the door frame of the present invention can include one or more grounding pieces (e.g., lugs, screws, pins, rods, plates) so as ground the door frame and in turn, also the door itself through contact with the door frame. This grounding piece or pieces can be electrically connected to a ground (e.g., a ground rod). As an example, the door frame can have one or more grounding pieces, such as two or more, or three or more, or four or more, or five or more individual grounding pieces. As a more specific example, one or more or each of the door head, a door sill, and door jambs can have one or more (e.g., 2 or 3 or 4 or more) ground pieces that are ultimately connected to a ground (e.g., grounding rod).

As an option, RF seals of the door system can be part of RF gasket seal assemblies attached to the door frame, the metal door, or both. The RF gasket seal assemblies create an electrical contact between the metal door and the door frame when the metal door is closed. The RF gasket seal assemblies can be located at the door jambs, the door head, and the door sill to electrically seal the gaps between the metal door and the door frame.

The RF gasket seal assemblies can each include a housing that contains the RF seals. The housing can be fastened to the door frame (or portion thereof) or the metal door (or portion thereof). The RF seals protrude or extend from the housing to engage the door frame, the metal door, or both when the metal door is closed. The RF seals can be made of a compressible and conductive material. For example, the RF seals can be a neoprene/silicone core with a conductive metal woven wire around the core.

As an option, each of the RF gasket seal assemblies are adjustable so that a complete electrically conductive seal can be formed around the door head, the door jambs and the door sill of the door frame. For example, the RF gasket seal assemblies can be adjusted such that the RF seals protrude further away or closer to the housing. The RF adjustable gasket seals can be adjusted to prevent breaks in electrical conductivity between the door frame and the metal door.

As an option, the door system includes acoustic gasket seal assemblies or sound proofing seals. The acoustic gasket seal assemblies can contain sound seals to create an acoustically sealed contact between the metal door and the door frame when the metal door is closed. The acoustic gasket seal assemblies can be located at the door jambs, the door head, and the door sill to acoustically seal the gaps between the metal door and the door frame.

The acoustic gasket seal assemblies can each include a housing that contains sound seals. The housing can be fastened to the door frame or the metal door. The sound seals protrude from the housing to engage the door frame, the metal door, or both when the metal door is closed. The sound seals can be made of a compressible acoustic material, such an acoustic foam, an acoustic rubber, magnetic material such as strips, or any combinations thereof, and the like.

As an option, each of the acoustic gasket seal assemblies are adjustable so that a complete acoustic seal can be formed around the door head, the door jambs and the door sill of the door frame. For example, the acoustic gasket seal assemblies can be adjusted such that the sound seals protrude further away or closer to the housing. The acoustic adjustable gasket seals can be adjusted to prevent unsealed gaps between the door frame and the metal door.

As an option, each of or a portion of the gasket seal assemblies can be a combination RF and acoustic gasket seal assembly.

The door frame can include a door stop instead of or in conjunction with gasket seal assemblies. The door stop extends inwardly towards a door opening from an inner surface of the door jambs, the door head, and possibly, the door sill (threshold). An outer surface of the front panel of the metal door abuts against the inner side of the door stop when the metal door is closed. The door frame seals can be fastened or attached directly to the inner side of the door stop or be a part of the door stop. The door frame seals can include the RF seal and the sound seal each fastened or attached to the inner side of the door stop adjacent to one another or in a close proximity to one another.

As an option, a bracket(s) and/or seal assemblies can be fastened to the bottom of the door at the outer surface of the front panel, back panel, or both. The bracket can include a sound insulator, such as solid neoprene, an RF seal, or both. The sound insulator and/or RF seal engages with the threshold when the metal door is closed, sealing any air gaps and/or electrical gaps between the threshold and the door.

FIG. 1 illustrates a front view of an exemplary door system 10 of the present invention. The door system includes at least a metal door 12, a door frame 14, and at least one hinge 16 hingedly connecting the metal door 12 to the door frame 14. The door system 10 can include one or more hinges 16, such as three hinges 16. The door frame 14 includes a door head 18, a door sill 20, and door jambs 22. The door system 10 further includes a door handle 24 and a locking hardware (not shown). The metal door 12 and the door frame 14 of the door system 10 each have a steel outer surface with a first metal layer in contact with and that encapsulates or covers or coats the steel outer surface, and a second metal layer in contact with and that encapsulates or covers or coats the first metal layer. The first metal layer is different from the second metal layer. The first and second metal layers are the same metal layers previously described in detail.

Figure 2:
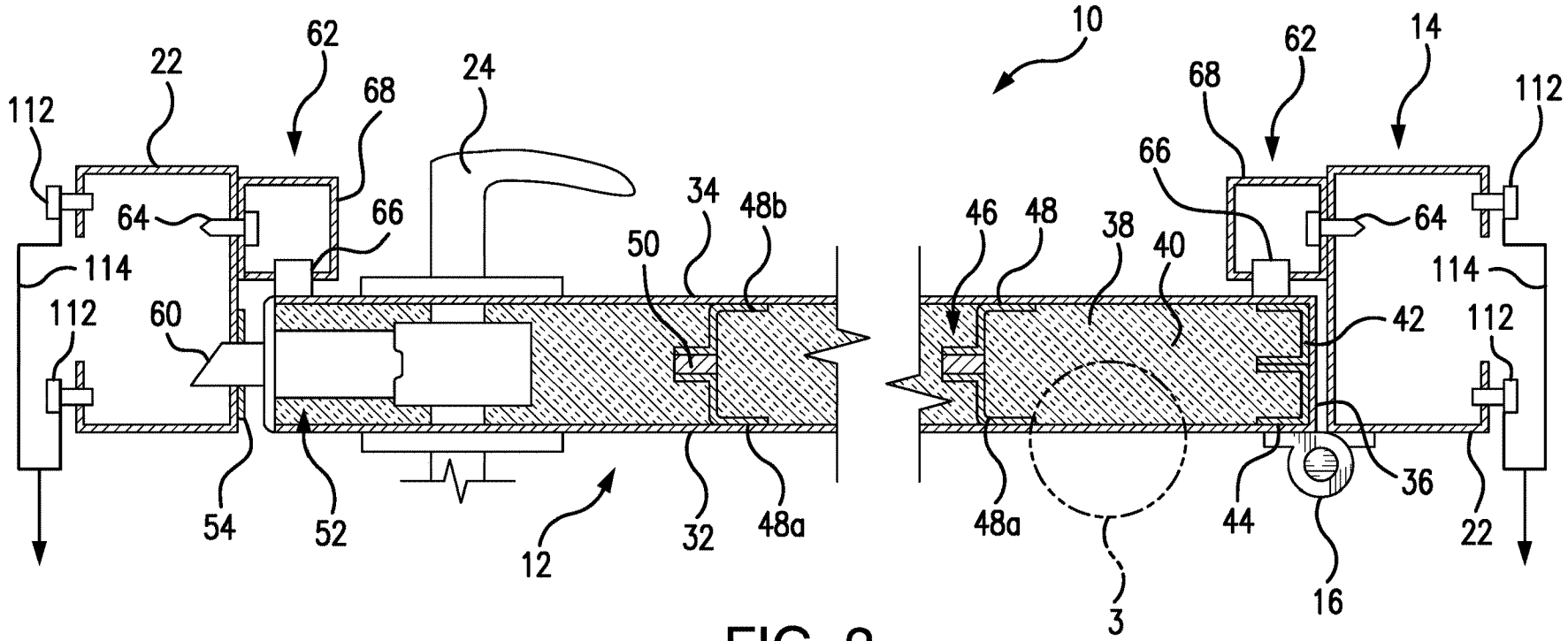
FIG. 2 is a cross-sectional view taken along line 2-2 of the door system of FIG. 1.

FIG. 2 is a cross-sectional view taken along line 2-2 of the door system 10 of FIG. 1, showing the metal door 12 connected to the door frame 14 by a hinge 16. The metal door 12 has outer panels 32, 34, 36 that define an internal space 38. The outer panels 32, 34, 36 can include a front panel 32 that has an interior surface and an exterior surface and a back panel 34 that has an interior surface and an exterior surface. The back panel 34 is spaced apart from the front panel 32 and is substantially parallel thereto with the interior surface of front panel 32 facing the interior surface of the back panel 34. The outer panels 32, 34, 36 can further include side panels 36, a top panel (not shown), and a bottom panel (not shown) that can be fastened to the front panel 32 and the back panel 34 to form the metal door 30. Interior surfaces of the outer panels 32, 34, 36 define the internal space 38 therebetween.

The front panel 32 and the back panel 34 can be integrally connected to the sides (top side, left side, right side and bottom side). In such embodiments, the front panel 32 is secured to the back panel 34 by internal connecting members 42. The internal connecting members 42 can be located or aligned substantially parallel to the sides or side panels 36. The internal connecting members 42 can include base segments 44 that are in contact with the interior surfaces of the front panel 32 and the back panel 34. The base segments 44 can be attached to the interior surfaces of the front panel 32 and the back panel 34 by welding, adhesive bonding, or other bonding techniques, or any combinations thereof.

The metal door 12 can further include internal reinforcements 46 within the internal space 38. The internal reinforcements 46 provide additional rigidity and strength to the metal door 12. The internal reinforcements 46 are an array of support members 48 disposed vertically relative to the front and back panels 32, 34 of the metal door 12.

The metal door 12 can further include at least one crosspiece (not shown) that runs perpendicular to the support members 48. The crosspiece can be notched at regular intervals with each notch dimensioned to receive an end of one of support members 48 so that the crosspiece provides lateral separation between the support members 48.

As illustrated in FIG. 2, the support members 48 can include two separate pieces, such as a first section 48*a* attached to the front panel 32 and a second section 48*b* attached to the back panel 34. Attenuator strips 50 can be disposed in between the first section 48*a* and the second section 48*b*. The first and second sections 48*a*, 48*b* each include lip edges that are located opposingly and spaced apart to form a corresponding array of gaps therebetween.

An array of attenuator strips 50 are respectively located in the gaps and bond the lip edges of the first and second sections 48*a*, 48*b* together.

An acoustically insulated core is disposed within the internal space 38. The acoustically insulated core is an insulating material 40 disposed within the internal space 38 in between the outer panels 32, 34, 36 and in between the support members 48 and crosspieces. The insulating material 40 provides additional sound insulation to the metal door 12. The insulating material 40 can include any of the insulating materials previously described in detail.

The metal door 12 further includes locking hardware 52 that engages with at least one strike plate 54 of the door jamb 22 in a locked position. The locking hardware 52 can include door handles 24 and a dead bolt 60 that are attached to the metal door 10. The locking hardware 52 can be mounted to the metal door 12 and the at least one strike plate 54 can be mounted to the door jamb 22 using conductive sealants, conductive gaskets, or both.

The door system 10 further includes door frame seals 66, such as RF seals, sound seals, or a combination thereof. The door frame seals 66 are fastened to the door jambs 22, the door sill (not shown), and the door head (not shown) of the door frame 14. The door frame seals 66 provide in part conductivity between the metal door 12 and the metal door frame 14 when the metal door is closed.

The door frame seals 66 of the door system 10 can be part of an RF gasket seal assembly 62 attached the door frame 14. The RF gasket seal assembly 62 creates an electrical contact between the metal door 12 and the door frame 14 when the metal door 12 is closed. The RF gasket seal assembly 62 can be attached to the door jambs 22, the door head (not shown), and the door sill (not shown) to electrically seal the gaps between the metal door 12 and the door frame 14.

The RF gasket seal assembly 62 includes a housing 68 and the door frame seals 66 attached to and extending from the housing. The housing 68 can be fastened to the door frame 14 by fasteners 64 or other attachment devices (e.g., adhesive, tape and the like). The door frame seals 66 protrude from the housing 68 to engage the metal door 12 when the metal door 12 is closed. The door frame seals 66 can be made of a compressible and conductive material. For example, the door frame seals 66 can be a neoprene/silicone core with a conductive metal woven wire around the core. The RF gasket seal assembly 62 is adjustable so that a complete electric seal can be formed around the metal door 12. The RF gasket seal assembly 62 can be adjusted such that the door frame seals 66 protrude further away or closer to the housing 68. The door frame seals 66 can be adjusted to prevent breaks in electrical conductivity between the door frame 14 and the metal door 12.

The RF gasket seal assembly 62 can also act as or further include an acoustic gasket seal assembly. The acoustic gasket seal assembly includes a sound seal that engages the metal door 12 to create an acoustically sealed contact between the metal door 12 and the door frame 14 when the metal door 12 is closed.

The door frame 14, as shown in FIG. 2, includes one or more grounding pieces 112 (e.g., lugs, screws, pins, rods, plates) so as ground the door frame and also the door itself. The grounding piece or pieces are electrically connected via wiring 114 to a ground (e.g., a ground rod) as shown in FIG. 4.

Figure 3:
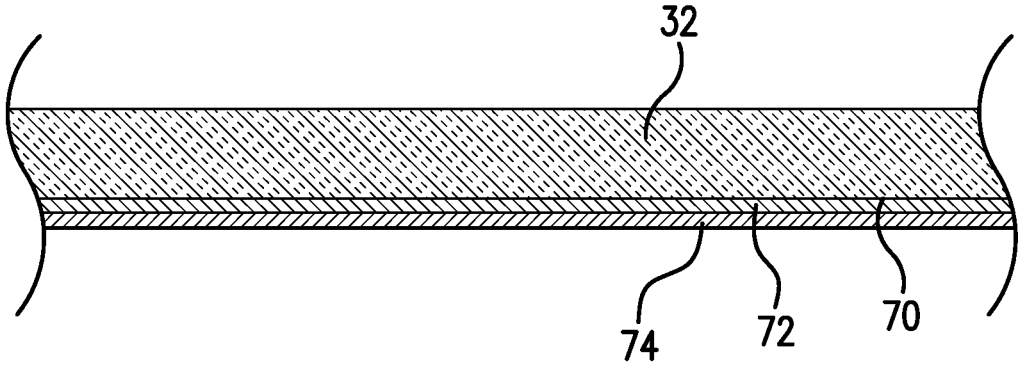
FIG. 3 is a section detail view of area 3 of the door system of FIG. 2.

FIG. 3 illustrates a section detail view of area 3 of the door system of FIG. 2. Area 3 includes the front panel 32 of the metal door 12 of FIG. 2. The front panel 32 can be made of steel and includes a steel outer surface 70. A first metal layer 72 is present on the steel outer surface 70 of the front panel 32. A second metal layer 74 is present on the first metal layer 72. The steel outer surface 70 is the same as the steel outer surface previously described in detail. The first metal layer 72 is the same as the first metal layer previously described in detail. The second metal layer 74 is the same as the second metal layer previously described in detail. As an option, the first metal layer 72 can be optional and not present, and the second metal layer 74 is present on the steel outer surface 70.

Although the first metal layer 72 and the second metal layer 74 are only illustrated on the steel outer surface 70 of the front panel 32 of the metal door, it is to be understood that the first metal layer 72 and the second metal layer 74 (as described herein) encapsulate or cover or coat the steel outer surface of the back panel, the sides or side panels, and the top and bottom panels of the metal door. The first metal layer 72 and the second metal layer 74 also encapsulate or cover or coat the steel outer surface of the door frame, including the steel outer surface of the door jambs, the door head, and the door sill/threshold. The first metal layer 72 and the second metal layer 74 encapsulate or cover or coat a remainder of the metal door and the door frame in the same configuration as shown in FIG. 3.

Figure 4:
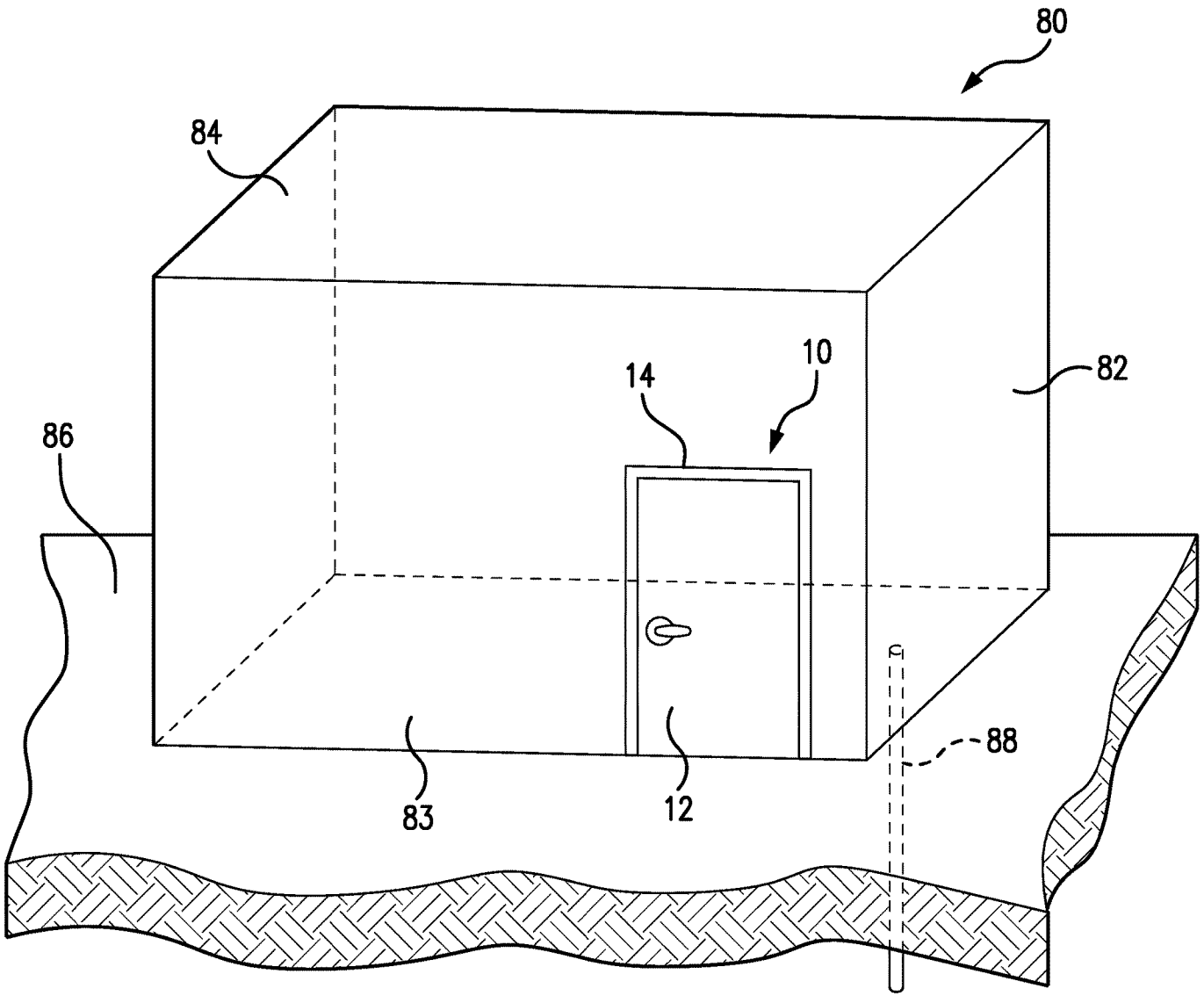
FIG. 4 is a perspective view of an enclosure that incorporates the door system of FIG. 1, the enclosure having RF shielding.

FIG. 4 illustrates a perspective view of an RF shielded enclosure 80 or room that incorporates the door system 10 of FIG. 1. The room can have any dimensions and any number of doors. The metal door 12 and the door frame 14 of the present invention are built into the enclosure 80. The metal door 12 and the door frame 14 of FIG. 4 each include the steel outer surface 70 having the first metal layer 72 and the second metal layer 74, as shown in FIG. 3. The RF shielded enclosure 80 includes RF shielded walls 82, an RF shielded floor 83, and an RF shielded ceiling 84 that each include a continuous electrically conductive surface or material. Thus, the RF shielded walls 82, the RF shielded floor 83, and the RF shielded ceiling 84 are electro-mechanically connected to the metal door 12 and the door frame 14. The electrically conductive surfaces of the RF shielded walls 82, the RF shielded floor 83, and the RF shielded ceiling 84 can include, but is not limited to, conductive paint, metal paneling or sheeting (e.g., Ultra NT Radiant Foil or similar RF material). An RF foil can be disposed inside of the walls. The RF shielded walls 82, the RF shielded floor 83, and the RF shielded ceiling 84 and the door 12 and door frame 12 of the enclosure 80 are all 'tied-in' such that all of the surfaces of the inner room are conductively connected together and thus can then be electrically grounded to the earth 86, such as by a grounding rod 88 or other grounding device or implement.

Figure 5:
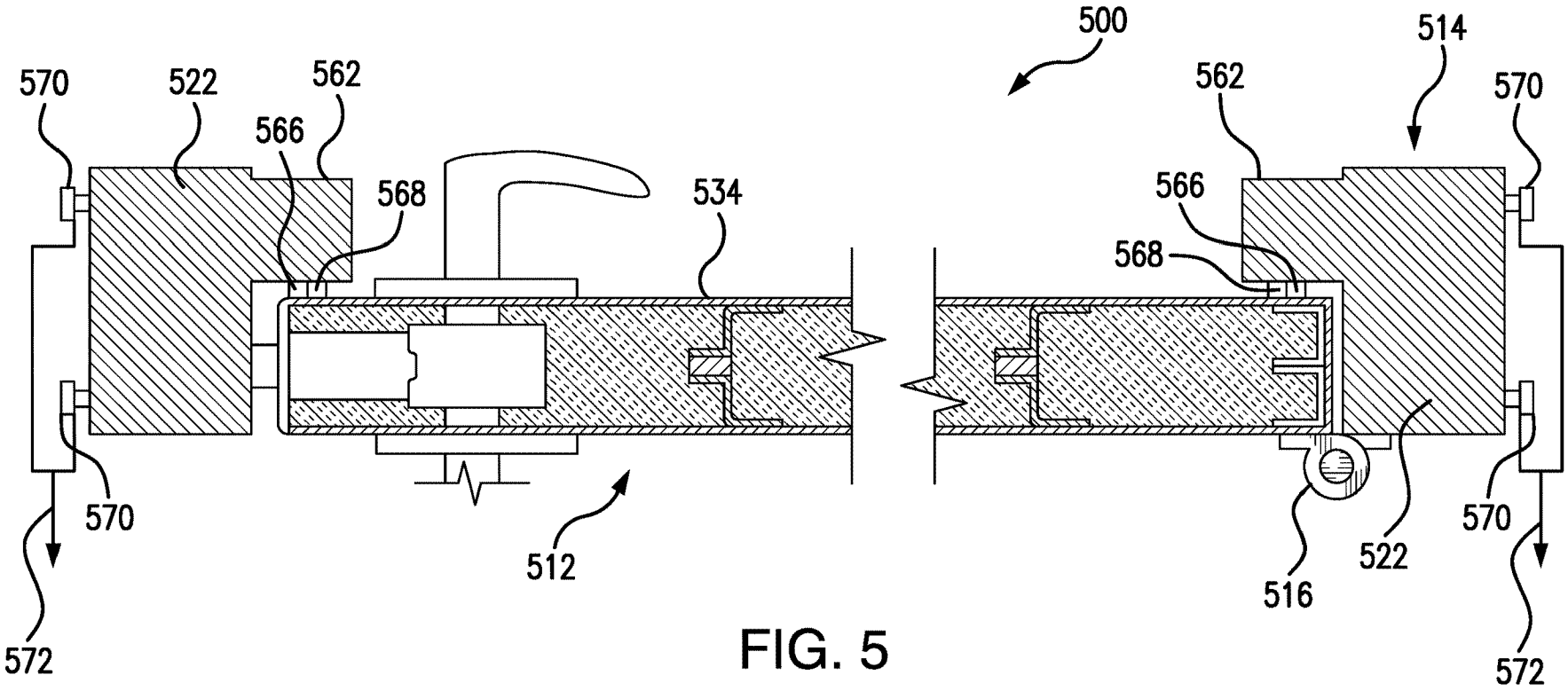
FIG. 5 is a cross-sectional view of a door system of an embodiment of the present invention, having sound control and RF shielding.

FIG. 5 is a cross-sectional view of one example of a door system 500 of the present invention. The door system 500 includes a metal door 512 connected to a door frame 514 by at least one hinge 516. The door system 500 shown in FIG. 5 is similar to the door system shown in FIG. 2, except the door frame 514 includes a door stop 562 instead of or in conjunction with gasket seal assemblies. The door stop 562 extends inwardly towards a door opening from an inner surface of door jambs 522, and optionally a door sill (not shown), and/or optionally a door head (not shown) of the door frame 514. An outer surface of a back panel 534 of the metal door 512 abuts against the inner side of the door stop 562 when the metal door 512 is closed.

The door system 500 further includes door frame seals 566, 568. The door frame seals 566, 568 are fastened or attached to the inner side of the door stop 562 by adhesives, tapes, fasteners, or the like. The door frame seals 566, 568 can be in the form of endless gaskets that are fastened along the entire inner side of the door stop 562.

The door frame seals 566, 568 can include an RF seal 566 and a sound seal 568 each fastened or attached to the entire inner side of the door stop 562 adjacent to one another or in a close proximity to one another.

The RF seal 566 can be or include a neoprene/silicone core with a conductive metal woven wire around the core. The RF seal 566 provides conductivity between the metal door 512 and the metal door frame 514 when the metal door is closed to electrically seal the gaps between the metal door 512 and the door frame 514.

The sound seal 568 can include a sound dampening and compressible material, such as an acoustic foam, an acoustic rubber, magnetic material, or other similar materials. The sound seal 568 creates an acoustically sealed contact between the metal door 512 and the door frame 514 when the metal door 512 is closed.

The door frame 514, as shown in FIG. 5 also includes one or more grounding pieces 570 (e.g., lugs, screws, pins, rods, plates) so as to ground the door frame 514 and also the metal door 512 itself. The grounding piece or pieces 570 are electrically connected via wiring 572 to a ground (e.g., a ground rod) as shown in FIG. 4.

Figure 6:
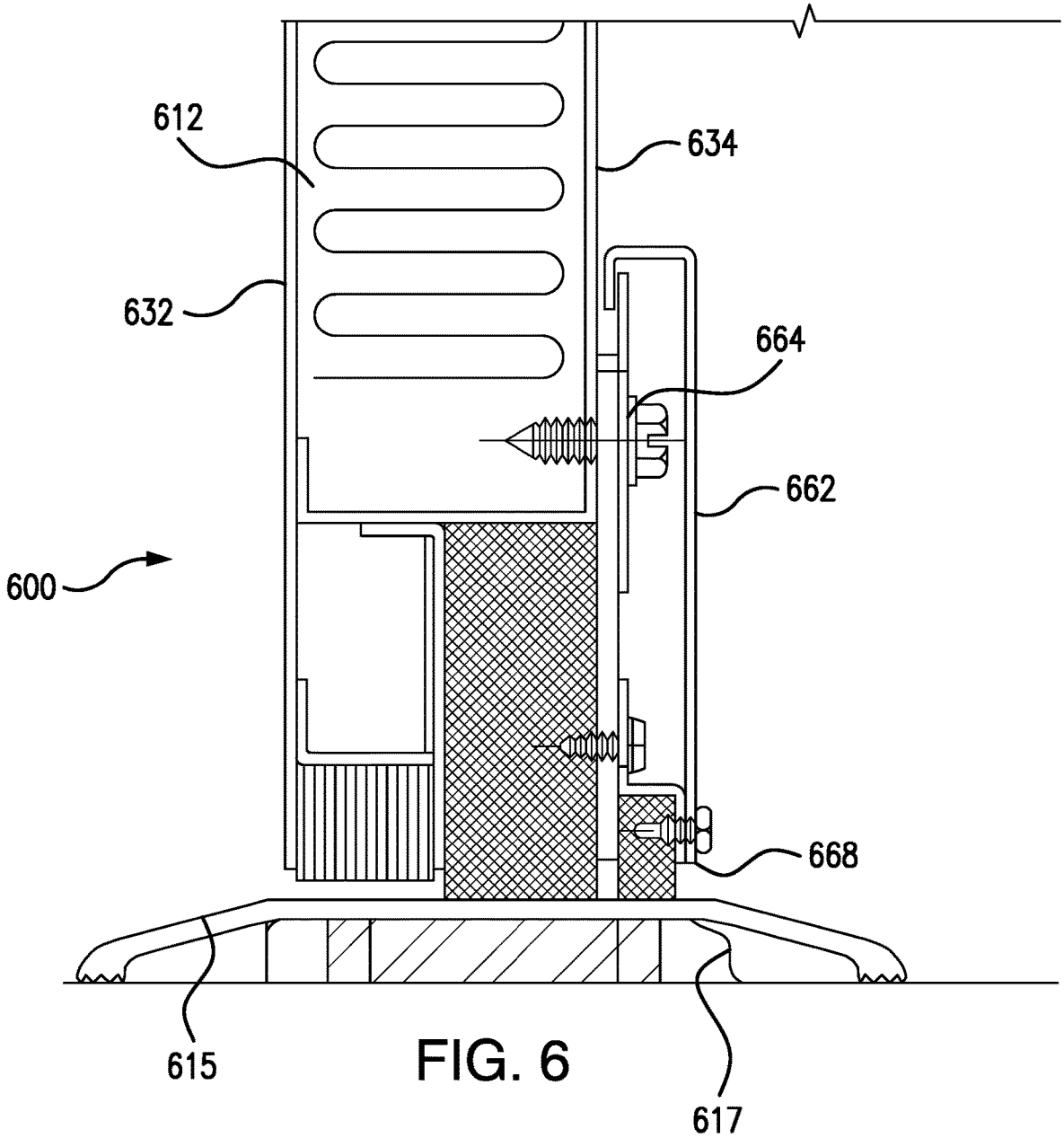
FIG. 6 is a detailed cross-sectional view of a bottom of a door system of an embodiment of the present invention, having sound control and RF shielding.

FIG. 6 is a cross-sectional view of an example of a bottom of a door system 600 of the present invention illustrating a metal door 612 and a threshold 615. The door system 600 shown in FIG. 6 could be the bottom of the door systems shown in FIGS. 2 or 5 or any of the embodiments described herein. The metal door 612 has outer panels 632, 634 including a front panel 632 and a back panel 634. The threshold 615 can be a steel or stainless-steel threshold that is electro-mechanically connected to the door frame. The threshold 615 can have conductive seals, conductive caulk, and/or a metal foil 617 disposed underneath. A seal assembly including a bracket 662 or housing can be secured to an outer surface of the back panel 634 of the metal door 612 by bolts 664. Attached to the bracket 662 is a seal 668. The seal 668 can include an RF seal, a sound insulator, or both. The seal 668 engages with the threshold 615 when the metal door 612 is closed, sealing any air gaps and/or electrical gaps between the threshold 615 and the door 612.

Figure 7:
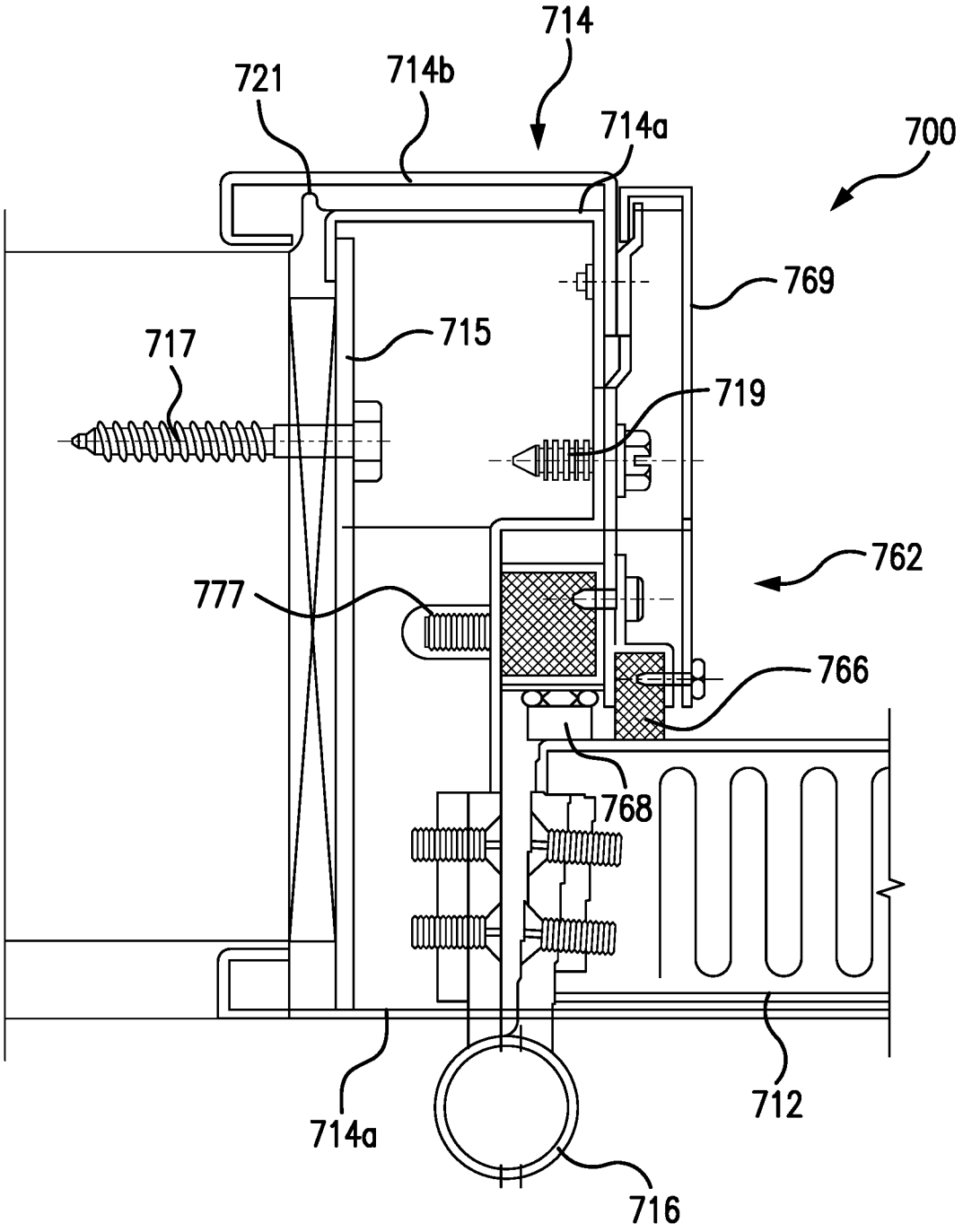
FIG. 7 is a detailed cross-sectional view of a door system of an embodiment of the present invention, having sound control and RF shielding.

FIG. 7 is a cross-sectional view of an example of a door system 700 of the present invention with a split door frame 714. The split door frame 714 has sound control and RF shielding properties and can be used with any embodiment of the door system described herein. The split door frame 714 shown in FIG. 7 includes a main frame 714*a* and a cover frame 714*b*. A metal foil 721 can extend from the walls of the enclosure and into the main frame 714*a*, the cover frame 714*b*, or both. To secure the split door frame 714 to a doorway of an enclosure, an attachment plate 715 is secured to an inner wall of the doorway of the enclosure by an anchor 717 or other mechanical fasteners. The main frame 714*a* is then clipped on or fastened to the attachment plate 715. The main frame 714*a* provides the door jamb on a front side of the doorway. The cover frame 714*b* is then secured to the main frame 714*a* and provides the door jamb on the back side of the doorway. A metal door 712 is secured to the main frame 714*a* by at least one hinge 716, such as three or more hinges 716. The split door frame 714 allows for walls of an enclosure having RF shielding to already be finished and painted when installing the split door frame 714 and metal door 712.

The door system 700 further includes door frame seals 766, 768 such as an RF seal 766 and a sound seal 768. The RF seal 766 can include a neoprene/silicone core with a conductive metal woven wire around the core. The RF seal 766 provides conductivity between the metal door 712 and the split door frame 714 when the metal door 712 is closed to electrically seal the gaps between the metal door 712 and the split door frame 714. The sound seal 768 can include a sound dampening and compressible material, such as an acoustic foam, an acoustic rubber, magnetic material, or other similar materials. The sound seal 768 creates an acoustically sealed contact between the metal door 712 and the split door frame 714 when the metal door 712 is closed.

The door frame seals 766, 768 of the door system 700 can be part of an RF gasket seal assembly 762 attached the split door frame 714. The RF gasket seal assembly 762 creates an electrical contact between the metal door 712 and the split door frame 714 when the metal door 714 is closed.

The RF gasket seal assembly 762 includes a housing 769 and the door frame seals 766, 768 attached to and extending from the housing 769. The housing 769 can be fastened to the main frame 714*a*, the cover frame 714*b*, or both by a screw 719, bolt, or other attachment devices. The door frame seals 766, 768 protrude from the housing 769 to engage the metal door 712 when the metal door 712 is closed. The door frame seals 766, 768 can be made of a compressible and conductive material. For example, the door frame seals 766, 768 can be a neoprene/silicone core with a conductive metal woven wire around the core.

A grounding lug 777 can be welded to the main frame 714*a*. The grounding lug 777 is electrically connected to the RF seal 766. Wiring can attach to the grounding lug. The wiring can be electrically connected to a ground (e.g., a ground rod) as shown in FIG. 4.

Figure 8:
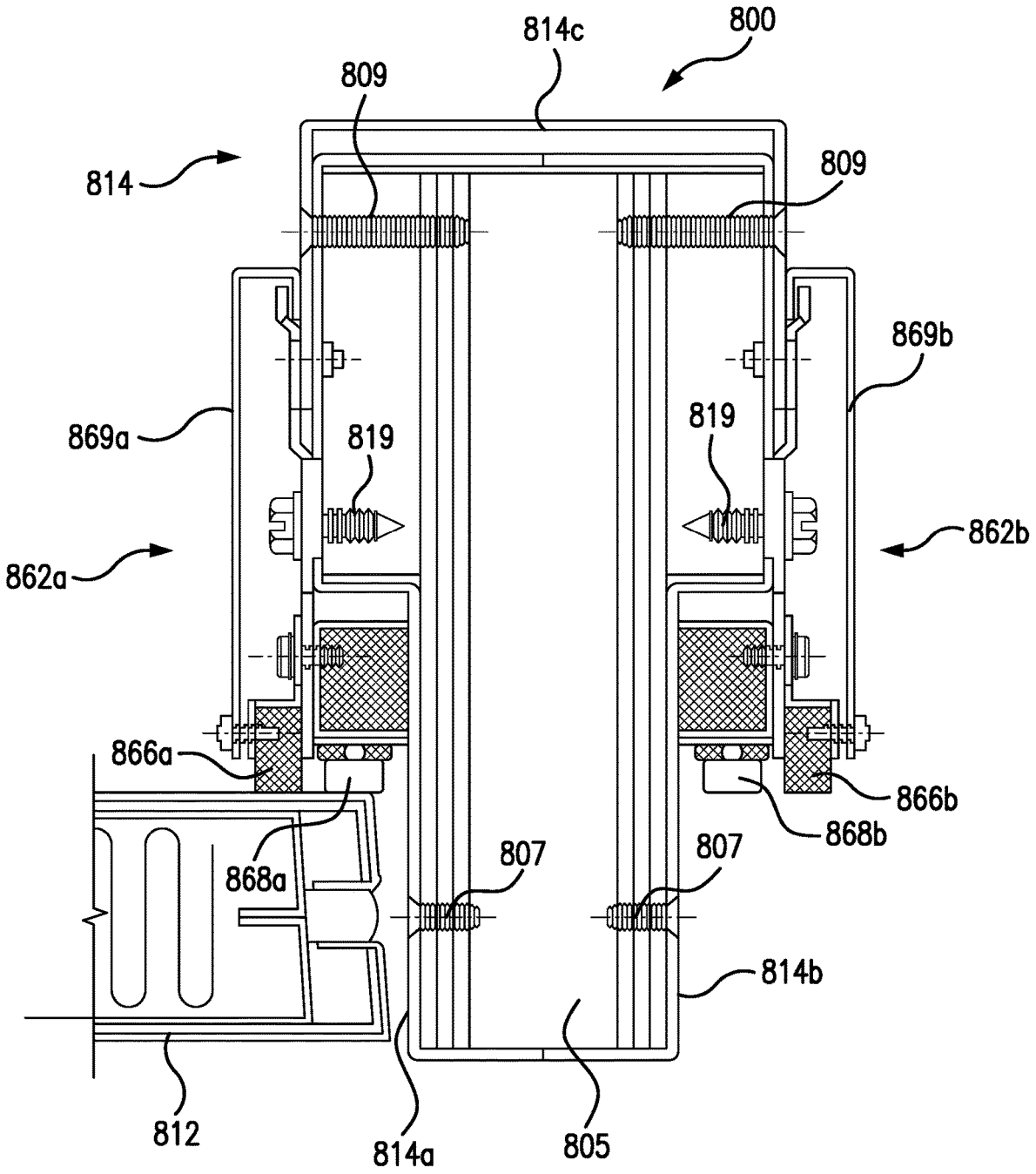
FIG. 8 is a detailed cross-sectional view of a door system of an embodiment of the present invention, having sound control and RF shielding.

As mentioned above, the present invention can be incorporated in a double door system. FIG. 8 is a cross-sectional view of an example of a double door system 800 of the present invention with a split door frame 814 attached to a mullion 805. The split door frame 814 includes a first main frame 814*a*, a second main frame 814*b*, and a cover frame 814*c*. To secure the split door frame 814 to the mullion 805, the first main frame 814*a* can be secured to a first side of the mullion 805 and the second main frame 814*b* can be secured to a second side of the mullion 805 by screws 807, bolts, or other mechanical fasteners. The first main frame 814*a* and the second main frame 814*b* can provide the door jamb on a front side of the mullion 805. A seam in between the first main frame 814*a* and the second main frame 814*b* can be welded, connecting the main frames 814*a*, 814*b* together. The cover frame 814*c* is then secured to the first main frame 814*a*, the second main frame 814*b*, and/or the mullion 805 by screws 809, bolts, or other mechanical fasteners. The cover frame 814*c* provides the door jamb on the back side of the mullion 805. Metal doors 812 can be hingedly secured to the main frames 814*a*, 814*b* in the doorways at the opposite side of the mullion 805.

The door system 800 further includes at least a first RF gasket seal assembly 862*a* secured to the first main frame 814*a* and a second RF gasket seal assembly 862*b* secured to the second main frame 814*b*.

The first RF gasket seal assembly 862*a* can include a first RF seal 866*a* and a first sound seal 868*a*. The first RF seal 866*a* can include a neoprene/silicone core with a conductive metal woven wire around the core. The first RF seal 866*a* provides conductivity between the metal door 812 and the split door frame 814 when the metal door 812 is closed to electrically seal the gaps between the metal door 812 and the split door frame 814. The first sound seal 868*a* can include a sound dampening and compressible material, such as an acoustic foam, an acoustic rubber, magnetic material, or other similar materials. The first sound seal 868*a* creates an acoustically sealed contact between the metal door 812 and the split door frame 814 when the metal door 812 is closed.

The first RF gasket seal assembly 862*a* further includes a first housing 869*a*. The first door frame seals 866*a*, 868*a* are attached to and extend from the first housing 869*a*. The first housing 869*a* can be fastened to the first main frame 814*a*, the cover frame 814*c*, or both by screws 819, bolts, or other attachment devices. The first door frame seals 866*a*, 868*a* protrude from the first housing 869*a* to engage the metal door 812 when the metal door 812 is closed.

The second RF gasket seal assembly 862*b* can include a second RF seal 866*b* and a second sound seal 868*b*. The second RF seal 866*b* can include a neoprene/silicone core with a conductive metal woven wire around the core. The second RF seal 866*b* provides conductivity between a second metal door (not shown) and the split door frame 814 when the second metal door is closed to electrically seal the gaps between the second metal door and the split door frame 814. The second sound seal 868*b* can include a sound dampening and compressible material, such as an acoustic foam, an acoustic rubber, magnetic material, or other similar materials. The second sound seal 868*b* creates an acoustically sealed contact between the second metal door and the split door frame 814 when the second metal door is closed.

The second RF gasket seal assembly 862*b* further includes a second housing 869*b*. The second door frame seals 866*b*, 868*b* are attached to and extend from the second housing 869*b*. The second housing 869*b* can be fastened to the second main frame 814*b*, the cover frame 814*c*, or both by screws 819, bolts, or other attachment devices. The second door frame seals 866*b*, 868*b* protrude from the second housing 869*b* to engage the second metal door when the second metal door is closed.

The present invention further includes a method of making the door system of the present invention. The method can include the following steps: applying a first metal layer to a steel outer surface of a metal door and a metal door frame so that the first metal layer encapsulates, coats, or covers the steel outer surface; and applying a second metal layer to the first metal layer so that the second metal layer encapsulates, coats, or covers the first metal layer. The method can further include applying or attaching one or more door frame seals to the metal door frame so as to provide electrical conductivity between the metal door and the metal door frame (especially when the door is closed).

The steel outer surface is the same as the steel outer surface previously described in detail. The first metal layer that is applied to the steel outer surface is the same as the first metal layer previously described in detail. The second metal layer that is applied to the first metal layer is the same as the second metal layer previously described in detail.

The first metal layer can be applied to the steel outer surfaces by one or more of the following techniques: fusion welding (fusion welding includes traditional welding methods such as gas tungsten arc and gas metal arc, where gas tungsten arc welding is also known as tungsten inert gas (TIG) welding, and gas metal arc welding is also known as metal inert gas (MIG) welding), low-dilution welding (e.g., laser welding, pulsed arc welding or electron beam), non-fusion joining (e.g., friction welding, diffusion bonding, soldering and explosion welding).

The second metal layer can be applied to the first metal layer by one or more of the following techniques: fusion welding (fusion welding includes traditional welding methods such as gas tungsten arc and gas metal arc, where gas tungsten arc welding is also known as tungsten inert gas (TIG) welding, and gas metal arc welding is also known as metal inert gas (MIG) welding), low-dilution welding (e.g., laser welding, pulsed arc welding or electron beam), non-fusion joining (e.g., friction welding, diffusion bonding, soldering and explosion welding).

As an option, the method can further include the step of applying a conductive paint or conductive veneer finish on top of said second metal layer.

As an option, the method further includes installing the metal door and the metal door frame into an RF shielded enclosure, the RF shielded enclosure including RF shielded walls, an RF shielded floor, and an RF shielded ceiling.

The present invention will be further clarified by the following examples, which are intended to be exemplary of the present invention.

EXAMPLES:

At their core, radio frequencies are electrical currents. Like sound waves, electrical current pulse, or oscillate, at certain speeds; the rate, at which a current pulses, in cycles per second, is called its frequency (or Hertz, abbreviated Hz). The range of frequencies usually being referred to when one speaks of radio frequencies, or RF, is between approximately 3 kHz to 300 GHz.

The goal of the tests performed was to determine the attenuation or shielding effectiveness of the door system of the present invention and the room using the same.

Figure 9:
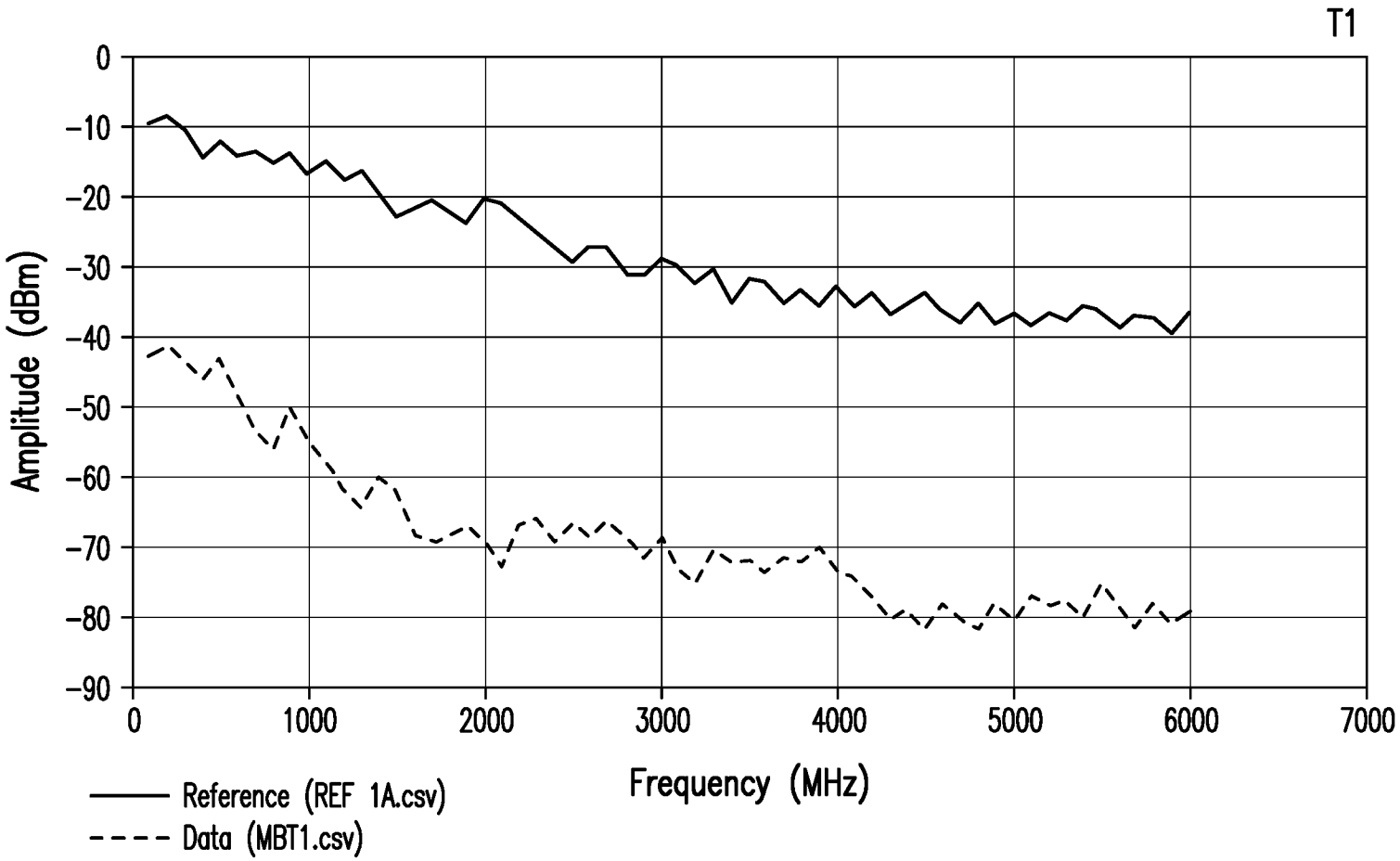
FIG. 9 is a graph showing the results of a Reference Test and a Data Test of a door system of the present invention incorporated with a room having a standard RF shielded wall setting.

RF attenuation was measured utilizing a swept multipoint frequency test (100 MHz- 6 GHz) that was performed on the room at its perimeter wall/doors. A total of three types of tests were performed for each location at each test point (Frequency): a reference test, a data test and an ambient test. FIG. 9 is a graph that shows the results of the Reference Test and the Data Test. An explanation of these tests follows:

Reference Test—Performed in open area with no obstruction between the transmitting and receiving antennae, and is primarily intended to confirm proper equipment functionality and calibration. This is the baseline test to measure the readings at each frequency point in respect to un-obstructed free space measurement to determine the actual attenuation of the Subject Under Test (SUT). A comparison of these measurements to those achieved during the subsequent Data Tests at the same test points is made. This test is performed once for each series of tests that utilizes the same antenna separation distance, power, test equipment and frequency spectrum.

Data Test—Performed with both the transmitting and receiving antennae functioning. The transmitting antenna is placed inside the space being tested, and the receiving antenna is placed outside the space at the same distance that the reference test utilized for antenna separation.

Figure 10:
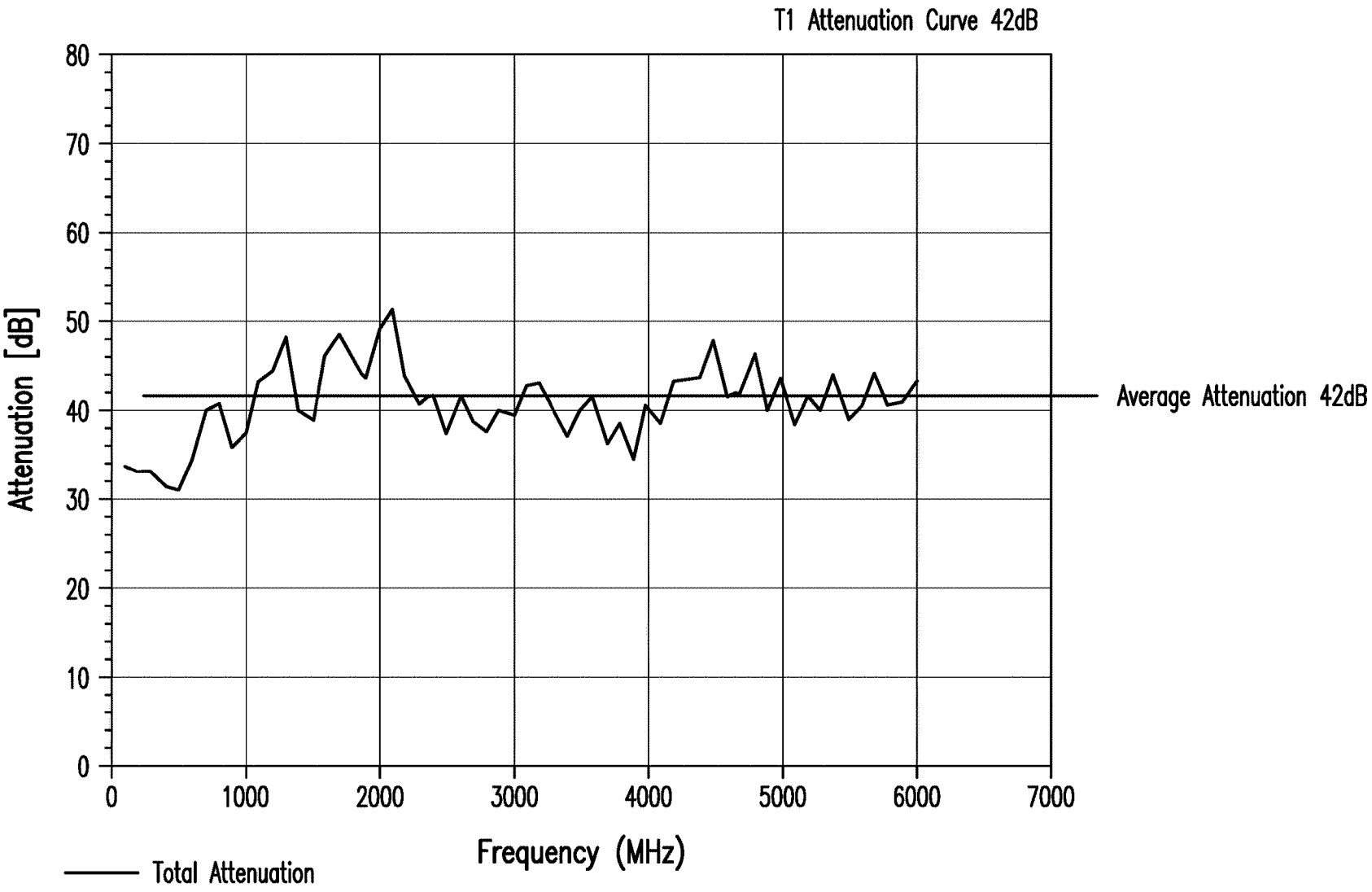
FIG. 10 is a graph showing the Average Attenuation of a door system of the present invention incorporated with a room having a standard RF shielded wall setting.

The test point measurements taken during the Data Test will be subtracted from the baseline test (Reference Test) to determine actual attenuation that the barrier is providing. This test is performed on each wall/barrier that is tested during the evaluation (RF attenuation testing). FIG. 10 is a graph that shows the Average Attenuation calculated using the results of the Data Test and Reference Test.

Ambient Test—Performed with only the receiving antenna, and measures the amplitude and frequency of any detectable signals in the frequency range under test. The transmitting antenna does not operate during this test. This test determines whether any signals generated outside the space interfere with the Reference and Data tests and how these signals can penetrate the facility under test. This test is performed at each Data Test location at the exact point where the receiving antenna was positioned for that test.

A spectrum analyzer; signal generator; and several Omni-directional broadband, mono-pole and log periodic antenna, were used to collect test, reference and ambient signal data. For the purposes of the test, the distance between the transmitting and receiving antennae was approximately (10) meters for both the Reference and Data Tests. The receiving antenna was placed on the outside of the interior wall of the tested enclosure and on the outside of the building for the Walk-A-Way RF test measurements (shots). The transmitting antenna and signal generator were positioned inside of the rooms for the Data test. During the ambient tests, the receiving antenna was placed accordingly inside and outside the building at the point where the receiving antenna was placed for testing and where measurements were taken.

The shielding effectiveness test was accomplished using a signal generator and measured using a spectrum analyzer. The tested frequency range was from 100 MHz to 6 GHz. The spectrum analyzer was configured for a swept, multi-test point matrix, or measurement scope. The signal generator was configured for the same band and swept with a 2 second delay on the matching frequency test point (201 total test points). The output from the signal generator was then feed to an amplifier and antenna for transmission, the measured/recorded at the receiver for analysis.

Calibration dates for all test equipment was completed within the current year. Testing was performed in accordance with U.S. Government specifications for testing the attenuation of a material in respect to IEEE 299 v6 and the RF attenuation provided by a facility in respect to ICD/ICS-705. The test equipment used were: Spectrum Analyzer from Agilent, a Signal Generator from RFD, a TX Omni Directional Wideband, TX/RX Antenna, and RX Antenna Omni Directional from TS, a RX Antenna LPA from Aaronia and a HP laptop computer.

The room tested was built with architecturally shielded walls and a metal door of the present invention. The architecturally shielded walls of the room included a standard RF shielded wall setting constructed of 3 ⅝" 16-gauge studs with sound insulation, two layers of ⅝" sheetrock on an outer side (insecure side) of the studs, one layer of ½" fire rated plywood on an inner side (secure side) of the studs, an RF Foil layer by COVER TECH on the plywood and then the foil covered with one layer of ⅝" drywall. The ceiling of the room was made in the same manner and the floor was concrete. The 'standard' RF shielded wall setting is defined as complying with the Intelligence Community Directive Number 705 (ICD 705). The metal door of the present invention was an Overly STC-50 door that was sand-blasted to clean the surfaces and then the surfaces had a layer of zinc applied onto it by fusing welding and then a layer of copper applied over the zinc layer by fusing welding—each layer was about 25 microns in thickness on average. A total of 4 tests were performed and validated. Each of four test parameters listed above was performed twice for each test to ensure validity.

Reference Test (1)/Data Test (4)/Ambient Test (2)=7 tests

Attenuation Achieved =Ref Test (A) minus Data Test (B) (A–B=Attenuation).

The tests were performed on the perimeter walls of the room designated for testing. The transmitter was placed in the center of the room and signal was measured externally-outside of the door of the door. The power output from the signal generator was set at 30 dBm (1 Watt) respectively for the frequency spectrum under test. The perimeter walls of the room provided more than adequate attenuation. A receiver was placed right outside the door system of the present invention.

The actual attenuation of the room was measured and the average attenuation measured across the room/door was about 42 dB. Since this is considered a field test as opposed to a laboratory test and takes into consideration the attenuation from not just the door itself, but the entire room, if the door/door system itself (alone) was measured for actual attenuation, the average attenuation of the door/door system itself (lab testing) would be well above 42 dB, namely over 50 dB such as from 50 dB to 75 dB.

Acoustical STC Testing per ASTM standards: An STC test was performed on the door system utilizing instrumented test equipment that utilizes a sound measurement system, speakers and microphones. The area under test was quiet while the tests were performed.

Test Duration—Approximately 5 Minutes per barrier (2 tests per barrier for accuracy).

Test—Digitized Audio signal and voice tracks are converted to analog form and injected into load speakers. The sound is then measured for loss between the source and receiver.

Test Configuration—The SENCORE 495 and microphone are placed 24" from the speaker (sound source) and a Reference track is recorded. Then, the SENCORE/Microphone was placed on the outside of the barrier under test, and the speaker (sound source) was situated on the inside of the room/barrier under test. The distance between the Speaker and the SENCORE was 24" during the second test. The result from the difference of the two tests is the STC rating of the barrier. The test duration was approximately 5 minutes.

The test equipment used for measurement of Sound Transmission Loss and STC rating were: a SENCORE 495, a directional microphone, a JBL directional speaker, and a HP laptop with acoustical test and measurement software.

In this field test, the door system tested yielded an instrumented STC rating such that loud speech cannot be heard intelligibly through the front door/wall.

Sound attenuation was measured utilizing a generated test sound file from a laptop and injected into a directional loud speaker. The sound source was measured inside the room with nothing between the speaker and the microphone attached to the analyzer. Then the same file at the same level was transmitted through the wall and the measurement taken again yielding the STC or sound attenuation of the barrier.

STC Test—Digitized Audio signal and voice tracks are converted to analog form and injected into load speakers. The sound was then measured for loss between the source and receiver. The test set and microphone were separated at a 24" interval, the audio track was then adjusted for >90 dB and transmitted through the speaker and measured on the analyzer.

Reference Test—Performed by measuring the transmitted audio track with 24" of open space between the Test Set/Microphone and Speaker. The audio track was played once through and saved for Transmission Loss comparison in respect to the Data Test.

Data Test-Performed with Speaker and Audio source placed inside the space being tested, and the Test Set and microphone placed outside the space at the same distance that the reference test utilized for separation (24"). The test measurement taken during the Data Test will be analyzed and compared to the reference Test for determination of actual Transmission Loss or Attenuation of the signal.

Calibration dates for all test equipment was completed within the current year. Testing was performed in accordance with U.S. Government specifications for testing the attenuation of a material and facilities in respect to applicable US Government Acoustical Attenuation Standards, namely the ASTM standards previously described.

The same room as for the RF attenuation measurements was tested and a receiver was located outside of the door system and a transmitter was located inside of the room right next to the door. A total of 4 tests were performed and validated. Each of the test parameters listed above was performed twice for each Test Point to ensure validity. The power output from the audio amplifier was set to 96 dB SPL for the barriers under test. The field test that takes into account the room and door provide an STC rating of 52 STC. In a laboratory test of the door/door system only, the STC rating of the door/door system would be over 52 STC such as above 55 or above 60 STC.

The present invention includes the following aspects/embodiments/features in any order and/or in any combination:

1. The present invention relates to a door system comprising a) a metal door, b) a metal door frame for the metal door, and c) one or more door frame seals,
   wherein said metal door and said metal door frame each comprising a steel outer surface with a first metal layer in contact with and covering said steel outer surface, and a second metal layer in contact with and covering said first metal layer, wherein said first metal layer is different from said second metal layer, and
   said one or more door frame seals located on said metal door frame and providing conductivity between said metal door and said metal door frame.
2. The door system or method or other embodiment of any preceding or following embodiment/feature/aspect, wherein said first metal layer comprises a zinc metal layer.
3. The door system or method or other embodiment of any preceding or following embodiment/feature/aspect, wherein said second metal layer comprises a copper metal layer.
4. The door system or method or other embodiment of any preceding or following embodiment/feature/aspect, further comprising a conductive paint or conductive veneer finish on top of said second metal layer.
5. The door system or method or other embodiment of any preceding or following embodiment/feature/aspect, wherein the steel outer surface comprises carbon steel.
6. An embodiment that is a door system comprising a) a metal door, b) a metal door frame for the metal door, and c) one or more door frame seals,
   wherein said metal door and said metal door frame each comprise a steel outer surface with a zinc metal layer in contact with and that covers or encapsulates said steel outer surface, and a copper metal layer in contact with and that encapsulates or covers said zinc metal layer, and
   said one or more door frame seals is located on said metal door frame and provides conductivity between said metal door and said metal door frame, and optionally,
   wherein said door system has a sound transmission class rating of at least 40 or at least 50 and/or optionally RF shielding attenuation of at least 40 dB, or at least 50 dB or at least 60 dB.
7. The door system or method or other embodiment of any preceding or following embodiment/feature/aspect, wherein said zinc metal layer has an average thickness of from about 5 microns to 175 microns, and said copper metal layer has an average thickness of from about 5 microns to about 175 microns.
8. The door system or method or other embodiment of any preceding or following embodiment/feature/aspect, wherein said zinc metal layer has an average thickness of from about 25 microns to about 125 microns, and said copper metal layer has an average thickness of from about 25 microns to about 125 microns.
9. The door system or method or other embodiment of any preceding or following embodiment/feature/aspect, wherein said zinc metal layer and said copper metal layer are fusion welded layers.
10. The door system or method or other embodiment of any preceding or following embodiment/feature/aspect, wherein the one or more door frame seals comprise neoprene/silicone core with a conductive metal woven wire around said core.
11. The door system or method or other embodiment of any preceding or following embodiment/feature/aspect, wherein said one or more door frame seals are compressible.
12. The door system or method or other embodiment of any preceding or following embodiment/feature/aspect, wherein said door system further comprises locking hardware.
13. The door system or method or other embodiment of any preceding or following embodiment/feature/aspect, wherein said locking hardware is attached to said metal door and includes either a conductive sealant, a conductive gasket, or both.
14. The door system or method or other embodiment of any preceding or following embodiment/feature/aspect, wherein said door system exhibits a RF shielding effectiveness of at least 40 dB or at least 50 dB or at least 60 dB over a frequency range of from about 10 MHz to about 2 GHz or from 10 kHz to 10 GHz.
15. The door system or method or other embodiment of any preceding or following embodiment/feature/aspect, further comprising a metal threshold with conductive seals or conductive caulk underneath.
16. The door system or method or other embodiment of any preceding or following embodiment/feature/aspect, further comprising conductive caulk at one or more seams or joints of the door system.
17. The door system or method or other embodiment of any preceding or following embodiment/feature/aspect, wherein said door system has a sound transmission class rating of at least STC 40 or at least STC 45, or at least STC 50, or from STC 40 to 60, and/or an RF shielding attenuation of at least 40 dB, or at least 45 dB, or at least 50 dB, or at least 60 dB, or from 40 dB to 80 dB.
18. The door system or method or other embodiment of any preceding or following embodiment/feature/aspect, wherein said metal door frame is a split door frame comprising a main frame and a cover frame, said main frame configured to provide a front door jamb on a front side of a doorway and said cover frame configured to provide a rear door jamb on a rear side of said doorway.
19. The door system or method or other embodiment of any preceding or following embodiment/feature/aspect, wherein said door system is a double door system, wherein the metal door comprises two metal doors, and the metal door frame is configured to secure within a doorway having a mullion.

20. A RF shielded room comprising RF shielded walls, a RF shielded ceiling, and a RF shielded floor, and the door system of any preceding or following embodiment/feature/aspect.

21. An embodiment that is a method of making a door system, said method comprising:

applying a first metal layer to a steel outer surface of a metal door and a metal door frame so that the first metal layer encapsulates the steel outer surface; and applying a second metal layer to the first metal layer so that the second metal layer encapsulates the first metal layer, applying one or more door frame seals on the metal door frame, wherein the one or more door frame seals located on said metal door frame provide electrical conductivity between said metal door and said metal door frame, and the door system optionally has a sound transmission class rating of at least STC 40 or at least STC 50 or at least STC 60, and/or an RF shielding attenuation of at least 40 dB, or at least 45 dB, or at least 50 dB, or at least 55 dB, or at least 60 dB or at least 70 dB or at least 80 dB.

22. The method or door system or other embodiment of any preceding or following embodiment/feature/aspect, wherein said first metal layer comprises a zinc metal layer and said second metal layer comprises a copper metal layer.

23. The method or door system or other embodiment of any preceding or following embodiment/feature/aspect, further comprising applying a conductive paint or conductive veneer finish on top of said second metal layer.

24. The method or door system or other embodiment of any preceding or following embodiment/feature/aspect, further comprising installing the metal door and the metal door frame to an RF shielded room, the RF shielded room comprising RF shielded walls, an RF shielded roof, and an RF shielded floor.

25. The method or door system or other embodiment of any preceding or following embodiment/feature/aspect, wherein the steps of applying said first metal layer and said second metal layer is carried out by fusion welding.

The present invention can include any combination of these various features or embodiments above and/or below as set forth in sentences and/or paragraphs. Any combination of disclosed features herein is considered part of the present invention and no limitation is intended with respect to combinable features.

Applicants specifically incorporate the entire contents of all cited references in this disclosure. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. A door system comprising a) a metal door, b) a metal door frame for the metal door, and c) one or more door frame seals, wherein said metal door and said metal door frame each comprising a steel outer surface with a first metal layer in contact with and covering said steel outer surface, and a second metal layer in contact with and covering said first metal layer, wherein said first metal layer is different from said second metal layer, and said one or more door frame seals located on said metal door frame and providing conductivity between said metal door and said metal door frame.

2. The door system of claim 1, wherein said first metal layer comprises a zinc metal layer.

3. The door system of claim 1, wherein said second metal layer comprises a copper metal layer.

4. The door system of claim 1, further comprising a conductive paint or conductive veneer finish on top of said second metal layer.

5. The door system of claim 1, wherein the steel outer surface comprises carbon steel.

6. The door system of claim 1, wherein one or more door frame seals comprise neoprene/silicone core with a conductive metal woven wire around said core.

7. The door system of claim 1, wherein said one or more door frame seals are compressible.

8. The door system of claim 1, wherein said door system further comprises locking hardware.

9. The door system of claim 8, wherein said locking hardware is attached to said metal door and includes a conductive sealant, a conductive gasket, or both.

10. The door system of claim 1, wherein said door system exhibits a RF shielding effectiveness of at least 40 dB over a frequency range of from about 10 MHz to about 2 GHz.

11. The door system of claim 1, further comprising a metal threshold with conductive seals or conductive caulk underneath.

12. The door system of claim 1, further comprising conductive caulk at one or more seams or joints of the door system.

13. The door system of claim 1, wherein said door system has a sound transmission class rating of at least STC 40 and RF shielding attenuation of at least 40 dB.

14. The door system of claim 1, wherein said door system has a sound transmission class rating of at least STC 45 and RF shielding attenuation of at least 50 dB.

15. The door system of claim 1, wherein said door system has a sound transmission class rating of at least STC 50 and RF shielding attenuation of at least 60 dB.

16. The door system of claim 1, wherein said door system has a sound transmission class rating of from STC 40 to 60 and RF shielding attenuation of from 40 dB to 80 dB.

17. The door system of claim 1, wherein said metal door frame is a split door frame comprising a main frame and a cover frame, said main frame configured to provide a front door jamb on a front side of a doorway and said cover frame configured to provide a rear door jamb on a rear side of said doorway.

18. The door system of claim 1, wherein said door system is a double door system, wherein the metal door comprises two metal doors, and the metal door frame is configured to secure within a doorway having a mullion.

19. The door system of claim 1, wherein said first metal layer has a thickness of from about 5 microns to about 175 microns and said second metal layer has a thickness of from about 5 microns to about 175 microns.

20. The door system of claim 1, wherein said metal door frame further comprises door jambs, and said metal door is hingedly connected to said door jambs by a ball bearing hinge or a butt hinge or a pivot hinge.

21. A RF shielded room comprising RF shielded walls, a RF shielded ceiling, and a RF shielded floor, and the door system of claim 1.

22. A method of making the door system of claim 1, said method comprising:

applying said first metal layer to said steel outer surface of said metal door and said metal door frame so that the first metal layer encapsulates or covers the steel outer surface;

applying said second metal layer to the first metal layer so that the second metal layer encapsulates or covers the first metal layer; and applying said one or more door frame seals on the metal door frame, wherein the one or more door frame seals located on said metal door frame provide electrical conductivity between said metal door and said metal door frame.

23. The method of claim 22, wherein said first metal layer comprises a zinc metal layer and said second metal layer comprises a copper metal layer.

24. The method of claim 22, further comprising applying a conductive paint or conductive veneer finish on top of said second metal layer.

25. The method of claim 22, further comprising installing the metal door and the metal door frame to an RF shielded room, the RF shielded enclosure comprising RF shielded walls, an RF shielded ceiling and an RF shielded floor.

26. The method of claim 22, wherein the steps of applying said first metal layer and said second metal layer are carried out by fusion welding.

27. A door system comprising a) a metal door, b) a metal door frame for the metal door, and c) one or more door frame seals, wherein said metal door and said metal door frame each comprising a steel outer surface with a zinc metal layer in contact with and covering said steel outer surface, and a copper metal layer in contact with and covering said zinc metal layer, and said one or more door frame seals located on said metal door frame and providing conductivity between said metal door and said metal door frame.

28. The door system of claim 27, wherein said zinc metal layer has an average thickness of from about 5 microns to 175 microns, and said copper metal layer has an average thickness of from about 5 microns to about 175 microns.

29. The door system of claim 27, wherein said zinc metal layer has an average thickness of from about 25 microns to about 125 microns, and said copper metal layer has an average thickness of from about 25 microns to about 125 microns.

30. The door system of claim 27, wherein said zinc metal layer and said copper metal layer are fusion welded layers.

* * * * *